US010317809B2

(12) United States Patent
Hirakata et al.

(10) Patent No.: US 10,317,809 B2
(45) Date of Patent: Jun. 11, 2019

(54) IMAGE FORMING APPARATUS AND UNIT FOR IMAGE FORMING APPARATUS

(71) Applicant: FUJI XEROX CO., LTD., Tokyo (JP)

(72) Inventors: Masaki Hirakata, Kanagawa (JP); Hideya Katsuhara, Kanagawa (JP); Nobuyuki Torigoe, Kanagawa (JP); Yasutaka Matsumoto, Kanagawa (JP); Takeshi Iwanaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/916,251

(22) Filed: Mar. 8, 2018

(65) Prior Publication Data

US 2019/0094722 A1 Mar. 28, 2019

(30) Foreign Application Priority Data

Sep. 27, 2017 (JP) ..... 2017-185979

(51) Int. Cl.

| | |
|---|---|
| ***G03G 5/00*** | (2006.01) |
| ***G03G 15/00*** | (2006.01) |
| ***G03G 21/00*** | (2006.01) |
| ***G03G 5/043*** | (2006.01) |
| ***G03G 15/16*** | (2006.01) |

(Continued)

(52) U.S. Cl.

CPC ..... *G03G 5/0433* (2013.01); *G03G 15/0225* (2013.01); *G03G 15/16* (2013.01); *G03G 15/20* (2013.01); *G03G 15/751* (2013.01); *G03G 21/0094* (2013.01)

(58) Field of Classification Search

CPC ..... G03G 5/0433; G03G 5/14704; G03G 15/0225; G03G 15/16; G03G 15/20; G03G 15/0216; G03G 15/75; G03G 15/751; G03G 21/0011; G03G 21/0094

See application file for complete search history.

(56) References Cited

U.S. PATENT DOCUMENTS

| | | |
|---|---|---|
| 4,848,141 A | 7/1989 | Oliver et al. |
| 5,298,617 A | 3/1994 | Nukada et al. |

(Continued)

FOREIGN PATENT DOCUMENTS

| | | |
|---|---|---|
| EP | 0710893 | 5/1996 |
| JP | H04-189873 | 7/1992 |

(Continued)

*Primary Examiner* — Sophia S Chen
(74) *Attorney, Agent, or Firm* — JCIPRNET

(57) ABSTRACT

An image forming apparatus includes a photoreceptor that includes a conductive substrate, a photosensitive layer, and an inorganic surface layer arranged in that order, the inorganic surface layer containing a group 13 element and oxygen; a charging unit; an electrostatic image-forming unit; a developing unit; a transfer unit; a cleaning unit that performs cleaning by causing the cleaning blade to contact the surface of the photoreceptor; and a supply unit that supplies a fatty acid metal salt to a position where the cleaning blade in the cleaning unit contacts the photoreceptor. When the fatty acid metal salt is supplied, a portion of the surface of the photoreceptor downstream of the supply unit and upstream of the cleaning unit in a rotating direction of the photoreceptor is covered with a metal derived from the fatty acid metal salt at a coverage of about 40% or more.

12 Claims, 7 Drawing Sheets

(51) Int. Cl.
*G03G 15/20* (2006.01)
*G03G 15/02* (2006.01)

(56) References Cited

U.S. PATENT DOCUMENTS

| | | | | |
|---|---|---|---|---|
| 5,302,479 | A | 4/1994 | Daimon et al. | |
| 5,378,569 | A | 1/1995 | Nukada et al. | |
| 5,459,004 | A | 10/1995 | Katsumi et al. | |
| 7,276,318 | B2 | 10/2007 | Fujii et al. | |
| 7,496,324 | B2 | 2/2009 | Sugiura et al. | |
| 7,517,626 | B2 | 4/2009 | Fujii et al. | |
| 2009/0028618 | A1* | 1/2009 | Kabata | G03G 21/0011 399/346 |
| 2009/0074467 | A1* | 3/2009 | Seshita | G03G 9/0819 399/252 |
| 2017/0269486 | A1* | 9/2017 | Mera | G03G 5/14704 |
| 2018/0095372 | A1* | 4/2018 | Kigoshi | G03G 15/75 |

FOREIGN PATENT DOCUMENTS

| | | |
|---|---|---|
| JP | H05-098181 | 4/1993 |
| JP | H05-140472 | 6/1993 |
| JP | H05-140473 | 6/1993 |
| JP | H05-263007 | 10/1993 |
| JP | H05-279591 | 10/1993 |
| JP | H08-152730 | 6/1996 |
| JP | H08-176293 | 7/1996 |
| JP | H08-208820 | 8/1996 |
| JP | 2003-091143 | 3/2003 |
| JP | 2004-078147 | 3/2004 |
| JP | 2005-181992 | 7/2005 |
| JP | 2006-259661 | 9/2006 |
| JP | 2012-155282 | 8/2012 |

* cited by examiner

IMAGE FORMING APPARATUS AND UNIT FOR IMAGE FORMING APPARATUS

CROSS-REFERENCE TO RELATED APPLICATIONS

This application is based on and claims priority under 35 USC 119 from Japanese Patent Application No. 2017-185979 filed Sep. 27, 2017.

BACKGROUND

(i) Technical Field

The present invention relates to an image forming apparatus and a unit for an image forming apparatus.

(ii) Related Art

Electrophotographic image forming involves, for example, charging a surface of a photoreceptor, forming an electrostatic image on the surface of the photoreceptor according to image information, developing the electrostatic image with a developer containing a toner so as to form a toner image, and transferring and fixing the toner image onto a surface of a recording medium.

SUMMARY

According to an aspect of the invention, there is provided an image forming apparatus that includes an electrophotographic photoreceptor that includes a conductive substrate, a photosensitive layer, and an inorganic surface layer arranged in that order, the inorganic surface layer containing a group 13 element and oxygen; a charging unit that charges a surface of the electrophotographic photoreceptor; an electrostatic image-forming unit that forms an electrostatic image on the charged surface of the electrophotographic photoreceptor; a developing unit that supplies an electrostatic image developer to develop the electrostatic image on the surface of the electrophotographic photoreceptor so as to form a toner image; a transfer unit that transfers the toner image on the surface of the electrophotographic photoreceptor onto a surface of a recording medium; a cleaning unit that performs cleaning by causing the cleaning blade to contact the surface of the electrophotographic photoreceptor; and a supply unit that supplies a fatty acid metal salt to a position where the cleaning blade in the cleaning unit contacts the electrophotographic photoreceptor. When the fatty acid metal salt is supplied, a portion of the surface of the electrophotographic photoreceptor downstream of the supply unit and upstream of the cleaning unit in a rotating direction of the electrophotographic photoreceptor is covered with a metal derived from the fatty acid metal salt at a coverage of about 40% or more.

BRIEF DESCRIPTION OF THE DRAWINGS

Exemplary embodiments of the present invention will be described in detail based on the following figures, wherein.

DETAILED DESCRIPTION

Figure 1:
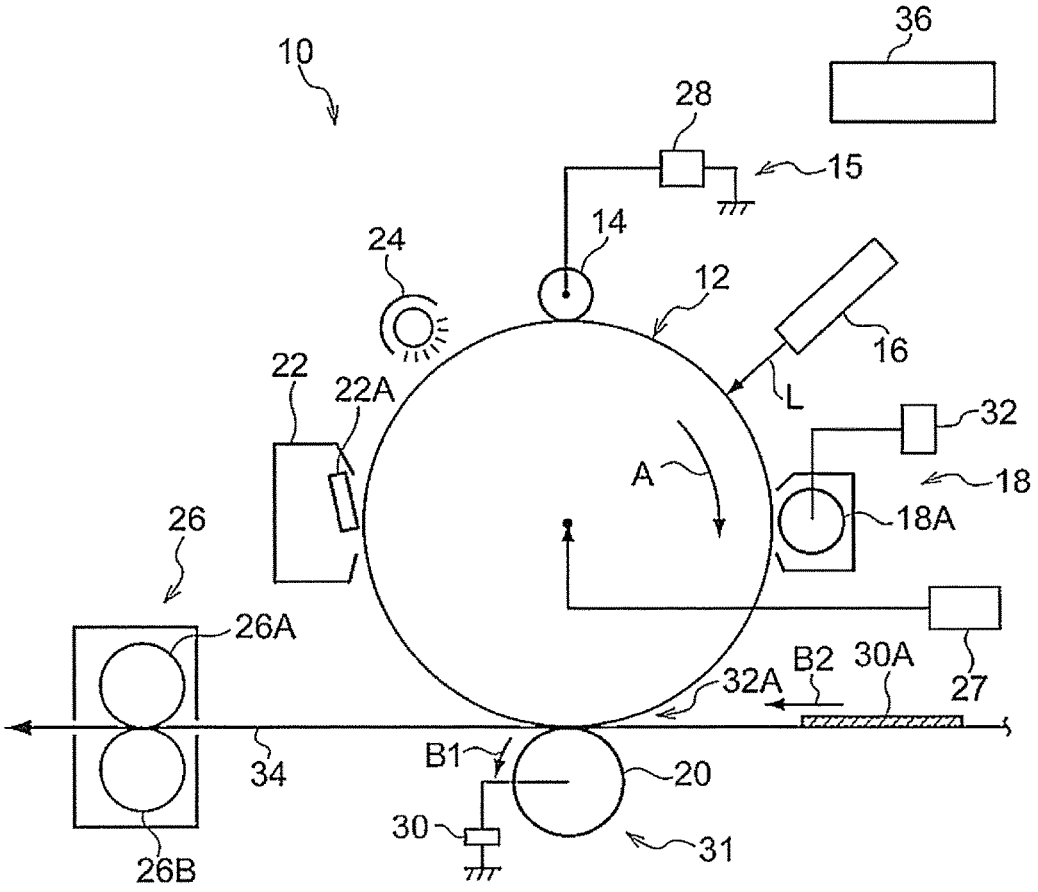
FIG. 1 is a schematic diagram illustrating one example of an image forming apparatus according to an exemplary embodiment.

An exemplary embodiment, which is one example of the present invention, will now be described in detail.

Image Forming Apparatus

An image forming apparatus according to an exemplary embodiment includes an electrophotographic photoreceptor (hereinafter, may be simply referred to as a "photoreceptor"), a charging unit that charges a surface of the photoreceptor, an electrostatic image-forming unit that forms an electrostatic image on the charged surface of the photoreceptor, a developing unit that supplies an electrostatic image developer so as to develop the electrostatic image on the surface of the photoreceptor to form a toner image, a transfer unit that transfers the toner image on the surface of the photoreceptor onto a surface of a recording medium; and a cleaning unit that cleans the surface of the photoreceptor.

The cleaning unit cleans the surface of the photoreceptor by causing a cleaning blade to contact the surface, and includes a supply unit that supplies a fatty acid metal salt to a position where the cleaning blade in the cleaning unit contacts the photoreceptor.

In addition, when the fatty acid metal salt is supplied, a portion of a surface of the photoreceptor downstream of the supply unit and upstream of the cleaning unit in the rotating direction of the photoreceptor is covered with a metal derived from the fatty acid metal salt at a coverage of 40% or more.

According to an electrophotographic image forming apparatus, an electrostatic image formed on a surface of a photoreceptor is developed with a developer containing a toner so as to form a toner image, the toner image is transferred from the photoreceptor to a surface of a recording medium, and then the toner image is fixed to form an image on the recording medium. After the toner image is transferred, the surface of the photoreceptor is cleaned with a cleaning unit to remove attaching matters, such as toner, that remained un-transferred. In addition, discharge products, such as nitrogen oxides (NOx) and their reaction products etc., may occur in the charging unit in the image forming apparatus, and if there are any discharge products attaching to the surface to the photoreceptor, they are removed by the cleaning unit. However, since the discharge products are strongly attached and are difficult to remove, for example, a cleaning unit that removes the attaching matters on the surface by scaping attaching matters off with a cleaning blade brought into contact with the surface of the photoreceptor is employed as the cleaning unit.

Meanwhile, a photoreceptor equipped with a conductive substrate and a photosensitive layer on the conductive substrate, the photosensitive layer forming the outermost surface, has been used. In other words, a photoreceptor, outermost surface of which is an organic layer, has been used. When this photoreceptor is cleaned by contacting a cleaning blade, the photosensitive layer, which constitutes the outermost surface layer, is gradually scraped off with the cleaning blade. In other words, high cleaning performance realized because the surface is refreshed as a new surface is exposed by scraping.

Meanwhile, a photoreceptor equipped with a photosensitive layer and an inorganic surface layer stacked on a conductive substrate, the inorganic surface layer constituting the outermost surface, has also been used. The inorganic surface layer has high hardness and is difficult to scrape even when the cleaning blade is contacted. Thus, the surface of the photoreceptor is not regenerated, and it is not easy to realize high cleaning performance using the cleaning blade.

In contrast, in this exemplary embodiment, a supply unit that supplies a fatty acid metal salt to a position where the cleaning blade in the cleaning unit contacts the photoreceptor is provided. Presumably, a layer formed by the supplied fatty acid metal salt is gradually scraped off by the cleaning blade. Thus, the attaching matters, such as toner remaining on the photoreceptor surface and discharge products that are difficult to remove, are removed along with the scraped fatty acid metal salt, and as a result, high cleaning performance is achieved.

However, when the amount of the fatty acid metal salt supplied to the photoreceptor surface is increased, for example, when the amount is increased so that the photoreceptor surface is covered with the metal derived from the fatty acid metal salt at a coverage of 40% or more, contamination by the fatty acid metal salt in the image forming apparatus may occur. In particular, when a charging roller that contacts the photoreceptor and charges the photoreceptor surface is provided as the charging unit, contamination of the charging roller surface with the fatty acid metal salt occurs, and charging non-uniformity between portions to which the fatty acid metal salt is attached and other portions may cause image defect (image nonuniformity).

In contrast, in the exemplary embodiment, an inorganic surface layer that contains a group 13 element and oxygen is provided as the inorganic surface layer in the photoreceptor. When the inorganic surface layer, which is the outermost surface layer of the photoreceptor, contains a group 13 element and oxygen, it is presumed that the fatty acid metal salt is suppressed from detaching from the photoreceptor surface due to the affinity between the fatty acid metal salt (metal therein) and oxygen and the like. As a result, even when the amount of the fatty acid metal salt supplied is increased so that the coverage by the metal derived from the fatty acid metal salt exceeds 40%, the fatty acid metal salt is retained on the surface of the photoreceptor, and contamination in the image forming apparatus (especially the contamination of the charging roller when a contact-type charging roller is provided as the charging unit) is suppressed.

As described above, in this exemplary embodiment, not only high cleaning performance is achieved by the cleaning blade, but also contamination in the apparatus by the fatty acid metal salt is suppressed.

Metal Coverage of Photoreceptor Surface

In this exemplary embodiment, when the fatty acid metal salt is supplied, a portion of a surface of the photoreceptor downstream of the supply unit and upstream of the cleaning unit in the rotating direction of the photoreceptor is covered with a metal derived from the fatty acid metal salt at a coverage (metal coverage) of 40% or more. The coverage may be 45% or more, or may be 50% or more.

At a metal coverage of 40% or more, a large amount of the fatty acid metal salt is supplied to the photoreceptor surface, and high cleaning performance is achieved by the cleaning blade.

The metal coverage of the photoreceptor surface is measured by the following procedure. The photoreceptor is cut to a 2 cm square, and the metal, such as Zn, derived from the fatty acid metal salt is measured with XPS (JPS-9000MX produced by JEOL Limited).

The metal coverage is measured in a state in which the fatty acid metal salt is supplied. Specifically, while the fatty acid metal salt is supplied from the supply unit to the photoreceptor surface in the image forming apparatus at the same time as performing cleaning by the cleaning blade, a halftone 30% image is printed on 100 sheets of A3 paper, and then the measurement is conducted on the portion of the surface of the photoreceptor downstream of the supply unit and upstream of the cleaning unit.

The structure of the image forming apparatus according to the exemplary embodiment will now be described in detail.

An image forming apparatus according to the exemplary embodiment includes a photoreceptor, a charging device that charges a surface of the photoreceptor, an electrostatic image-forming device that forms an electrostatic image on the charged surface of the photoreceptor, a developing device that supplies an electrostatic image developer so as to develop the electrostatic image formed on the surface of the photoreceptor to form a toner image, a transfer device that transfers the toner image formed on the surface of the photoreceptor onto a surface of a recording medium, a cleaning device that brings a cleaning blade into contact with the surface of the photoreceptor so as to clean the surface of the photoreceptor, and a supply unit that supplies a fatty acid metal salt at a position where the cleaning blade contacts the photoreceptor in the cleaning device.

When an electrostatic image developer containing particles of a fatty acid metal salt is to be used as the electrostatic image developer (toner therein), the developing unit serves also as the supply unit that supplies the fatty acid metal salt to the contact portion between the cleaning blade and the photoreceptor. In other words, when an electrostatic image developer containing particles of a fatty acid metal salt is to be used as the electrostatic image developer (toner therein), the supply unit means the developing unit.

Instead of using the electrostatic image developer containing particles of a fatty acid metal salt, a separate supply device (external supply device) that supplies the fatty acid metal salt to the surface of the photoreceptor may be provided to supply the fatty acid metal salt.

The image forming apparatus of the exemplary embodiment is applied to a known image forming apparatus such as a direct-transfer-type apparatus in which a toner image formed on a surface of a photoreceptor is directly transferred onto a recording medium; an intermediate-transfer-type apparatus in which a toner image on a surface of a photoreceptor is first transferred onto a surface of an intermediate transfer body and then the toner image on the surface of the intermediate transfer body is transferred onto a surface of a recording medium; or an image forming apparatus equipped with a charge erasing device that erases charges by applying charge-erasing light onto a surface of a photoreceptor after transfer of a toner image and before charging.

In the intermediate-transfer-type apparatus, the transfer device includes, for example, an intermediate transfer body having a surface onto which a toner image is to be transferred, a first transfer device that conducts first transfer of the toner image on the surface of the photoreceptor onto the surface of the intermediate transfer body, and a second transfer device that conducts second transfer of the toner image on the surface of the intermediate transfer body onto a surface of a recording medium.

In the image forming apparatus of the exemplary embodiment, a section that includes at least the photoreceptor may be configured as a unit for the image forming apparatus, the unit having a cartridge structure (process cartridge) that is detachably attachable to the image forming apparatus.

One example of such a unit for an image forming apparatus is a unit to be applied to an image forming apparatus equipped with a cleaning mechanism that cleans the surface of the photoreceptor by causing the cleaning blade to contact the surface. This unit includes a photoreceptor equipped with a conductive substrate, a photosensitive layer, and an inorganic surface layer, which contains a group 13 element and oxygen, arranged in this order; a supply unit that supplies a fatty acid metal salt to a position where the cleaning blade contacts the photoreceptor. Here, a portion of a surface of the photoreceptor downstream of the supply unit and upstream of the contact position of the cleaning blade in the rotating direction of the photoreceptor is covered with a metal derived from the fatty acid metal salt at a coverage of 40% or more when the fatty acid metal salt is supplied.

Although some examples of the image forming apparatus of the exemplary embodiment are described below, these examples are not limiting. Only relevant sections illustrated in the drawings are described, and descriptions of other sections are omitted.

FIG. 1 is a schematic diagram illustrating one example of an image forming apparatus according to the exemplary embodiment.

An image forming apparatus 10 of the exemplary embodiment is equipped with a photoreceptor 12, for example, as illustrated in FIG. 1. The photoreceptor 12 has a columnar shape, is connected to a drive unit 27, such as a motor, via a drive force propagating member (not illustrated), such as a gear, and is driven by the drive unit 27 and rotated about the axis of rotation indicated by a dot. In the example illustrated in FIG. 1, the photoreceptor 12 is driven and rotated in the arrow A direction.

In the vicinity of the photoreceptor 12, for example, a charging device 15 (an example of the charging unit), an electrostatic image-forming device 16 (an example of the electrostatic image-forming unit), a developing device 18 (an example of the developing unit), a transfer device 31 (an example of the transfer unit), a cleaning device 22 (an example of the cleaning unit), and a charge erasing device 24 are arranged in this order along the direction in which the photoreceptor 12 rotates. The image forming apparatus 10 is also equipped with a fixing device 26 that includes a fixing member 26A and a pressurizing member 26B disposed to contact the fixing member 26A. The image forming apparatus 10 is also equipped with a control device 36 that controls operations of the devices (units). The unit that includes the photoreceptor 12, the charging device 15, the electrostatic image forming device 16, the developing device 18, the transfer device 31, and the cleaning device 22 corresponds to the image forming unit.

In the image forming apparatus 10, at least the photoreceptor 12 may be provided as a process cartridge combined with another device or other devices.

The individual devices (units) of the image forming apparatus 10 will now be described in detail.

Electrophotographic Photoreceptor

The photoreceptor of the image forming apparatus of the exemplary embodiment includes a photosensitive layer and an inorganic surface layer stacked on a conductive substrate in that order. The photosensitive layer may be a single-layer-type photosensitive layer in which a charge generating material and a charge transporting material are contained in the same photosensitive layer so as to unify the functions or may be a function-separated, multilayer-type photosensitive layer that includes a charge generating layer and a charge transporting layer. When the photosensitive layer is a multilayer-type photosensitive layer, the order in which the charge generating layer and the charge transporting layer are arranged is not particularly limited; however, the photoreceptor may have a structure in which a charge generating layer, a charge transporting layer, and an inorganic surface layer are stacked in this order on a conductive substrate. Moreover, the photoreceptor may include layers other than these layers.

Figure 6:
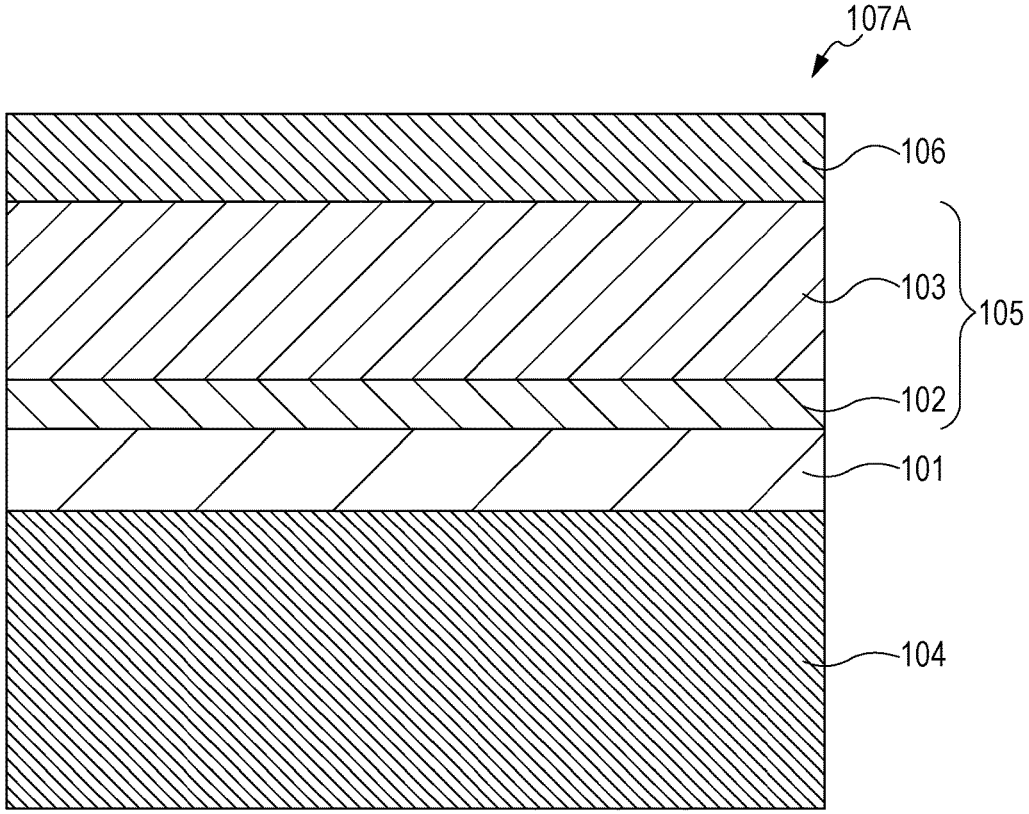
FIG. 6 is a schematic cross-sectional view illustrating an example of a layer structure of the electrophotographic photoreceptor of the image forming apparatus of the exemplary embodiment.

FIG. 6 is a schematic cross-sectional view illustrating an example of a layer structure of the photoreceptor of the image forming apparatus of the exemplary embodiment. A photoreceptor 107A has a structure in which an undercoat layer 101 is formed on a conductive substrate 104, and in which a charge generating layer 102, a charge transporting layer 103, and an inorganic surface layer 106 are sequentially formed on the undercoat layer 101. In the photoreceptor 107A, a photosensitive layer 105 in which the functions are distributed among the charge generating layer 102 and the charge transporting layer 103 is configured.

Figure 7:
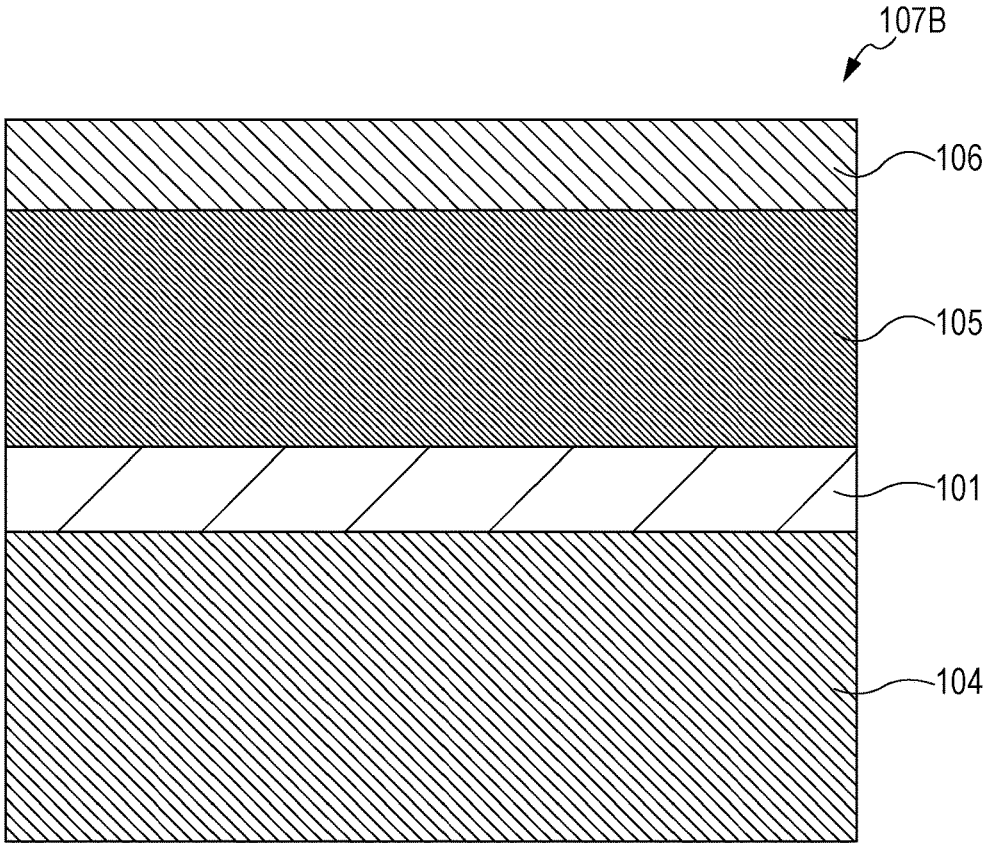
FIG. 7 is a schematic cross-sectional view illustrating another example of the layer structure of the electrophotographic photoreceptor of the image forming apparatus of the exemplary embodiment.

FIG. 7 is a schematic cross-sectional view illustrating another example of a layer structure of the photoreceptor of the image forming apparatus of the exemplary embodiment. A photoreceptor 107B illustrated in FIG. 7 has a structure in which an undercoat layer 101 is formed on a conductive substrate 104, and in which a photosensitive layer 105 and an inorganic surface layer 106 are sequentially stacked on the undercoat layer 101. In the photoreceptor 107B, a single-layer-type photosensitive layer in which a charge generating material and a charge transporting material are contained in the same photosensitive layer 105 so as to unify the functions is configured.

In the photoreceptor of this exemplary embodiment, the undercoat layer 101 is optional.

The photoreceptor of the exemplary embodiment will now be described in detail with reference numerals omitted from the description.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $10^{13}$ Ω·cm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the service life.

Examples of the surface roughening method include a wet honing method with which an abrasive suspended in water is sprayed onto a support, a centerless grinding with which the conductive substrate is pressed against a rotating grinding stone to perform continuous grinding, and an anodization treatment.

Another examples of the surface roughening method does not involve roughening the surface of the conductive substrate but involves dispersing a conductive or semi-conductive powder in a resin and forming a layer of the resin on a surface of the conductive substrate so as to create a rough surface by the particles dispersed in the layer.

The surface roughening treatment by anodization involves forming an oxide film on the surface of the conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or higher and 48° C. or lower. The thickness of the film may be, for example, 0.3 μm or more and 15 μm or less.

The Boehmite treatment is conducted by immersing the conductive substrate in pure water at 90° C. or higher and 100° C. or lower for 5 to 60 minutes or by bringing the conductive substrate into contact with pressurized steam at 90° C. or higher and 120° C. or lower for 5 to 60 minutes. The thickness of the film may be, for example, 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Undercoat Layer

The undercoat layer is, for example, a layer that contains inorganic particles and a binder resin.

Examples of the inorganic particles include inorganic particles having a powder resistivity (volume resistivity) of $10^2$ Ω·cm or more and $10^{11}$ Ω·cm or less.

Among these, metal oxide particles, such as tin oxide particles, titanium oxide particles, zinc oxide particles, or zirconium oxide particles, may be used as the inorganic particles that have the above-described resistivity. In particular, zinc oxide particles may be used.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, 10 mass % or more and 80 mass % or less, or may be 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate-based coupling agent, an aluminum-based coupling agent, and a surfactant. In particular, a silane coupling agent may be used, and an amino-group-containing silane coupling agent may be used.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent and another silane coupling agent may be used in combination. Examples of the another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis (4-naphthyl)-1,3,4-oxadiazole, 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, r may be attached to the surfaces of the inorganic particles.

Examples of the method for attaching the electron-accepting compound onto the surfaces of the inorganic particles include a dry method and a wet method.

The dry method is a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, or may be 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the inorganic particles as mentioned above, but may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butylate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

The surface roughness (ten-point average roughness) of the undercoat layer may be adjusted to be in the range of 1/(4n) (n represents the refractive index of the overlying layer) to ½ of λ where λ represents the laser wavelength used for exposure, in order to suppress moire images.

In order to adjust the surface roughness, resin particles and the like may be added to the undercoat layer. Examples of the resin particles include silicone resin particles and crosslinking polymethyl methacrylate resin particles. In order to adjust the surface roughness, the surface of the undercoat layer may be polished. Examples of the polishing method included buff polishing, sand blasting, wet honing, and grinding.

The undercoat layer may be formed by any known method. For example, a coating film is formed by using an undercoat-layer-forming solution prepared by adding the above-mentioned components to a solvent, dried, and, if needed, heated.

Examples of the solvent used for preparing the undercoat-layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat-layer-forming solution include known methods that use a roll mill, a ball mill, a vibrating ball mill, an attritor, a sand mill, a colloid mill, and a paint shaker.

Examples of the method for applying the undercoat-layer-forming solution to the conductive substrate include common methods such as a blade coating method, a wire bar coating method, a spray coating method, a dip coating method, a bead coating method, an air knife coating method, and a curtain coating method.

The thickness of the undercoat layer is set within the range of, for example, 15 μm or more, and may be set within the range of 20 μm or more and 50 μm or less.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound used in the intermediate layer include organic metal compounds that contain metal atoms, such as zirconium, titanium, aluminum, manganese, silicon, etc.

These compounds used in the intermediate layer may be used alone, or two or more of these compounds may be used as a mixture or as a polycondensation product.

In particular, the intermediate layer may be a layer that contains an organic metal compound that contains zirconium atoms or silicon atoms.

The intermediate layer may be formed by any known method. For example, a coating film is formed by using an intermediate-layer-forming solution prepared by adding the above-mentioned components to a solvent, dried, and, if needed, heated.

Examples of the application method used for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a layer formed by vapor-depositing a charge generating material. The layer formed by vapor-depositing the charge generating material is suitable when an incoherent light source, such as a light-emitting diode (LED) or an organic electro-luminescence (EL) image array, is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the infrared laser exposure, a metal phthalocyanine pigment or a metal-free phthalocyanine pigment may be used as the charge generating material. Specific examples thereof include hydroxygallium phthalocyanine disclosed in Japanese Unexamined Patent Application Publication Nos. 5-263007 and 5-279591 etc.; chlorogallium phthalocyanine disclosed in Japanese Unexamined Patent Application Publication No. 5-98181 etc.; dichlorotin phthalocyanine disclosed in Japanese Unexamined Patent Application Publication Nos. 5-140472 and 5-140473 etc.; and titanyl phthalocyanine disclosed in Japanese Unexamined Patent Application Publication No. 4-189873 etc.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment disclosed in Japanese Unexamined Patent Application Publication Nos. 2004-78147 and 2005-181992, or the like.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particular noticeable when a charge generating material, such as trigonal selenium or a phthalocyanine pigment, that is or a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed. Examples of the n-type charge generating material include, but are not limited to, compounds (CG-1) to (CG-27)

described in paragraphs 0288 to 0291 in Japanese Unexamined Patent Application Publication No. 2012-155282.

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ω·cm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using a charge-generating-layer-forming solution prepared by adding the above-mentioned components to a solvent, dried, and, if needed, heated. The charge generating layer may be formed by vapor-depositing a charge generating material. The charge generating layer may be formed by vapor deposition especially when a fused-ring aromatic pigment or a perylene pigment is used as the charge generating material.

Specific examples of the solvent for preparing the charge-generating-layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

The method for dispersing particles (for example, the charge generating material) in the charge-generating-layer-forming solution can use a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge-generating-layer-forming solution to 0.5 μm or less, 0.3 μm or less, or 0.15 μm or less.

Examples of the method for applying the charge-generating-layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is set within the range of, for example, 0.1 μm or more and 5.0 μm or less, or with in the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

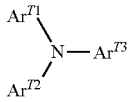

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Other examples of the substituent for each of the groups described above include substituted amino groups each substituted with an alkyl group having 1 to 3 carbon atoms.

(a-2)

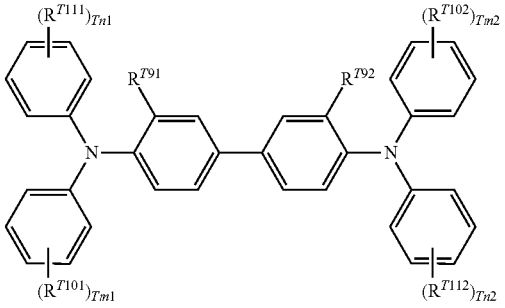

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Other examples of the substituent for each of the groups described above include substituted amino groups each substituted with an alkyl group having 1 to 3 carbon atoms.

Here, among the triarylamine derivatives represented by structural formula (a-1) and the benzidine derivatives represented by structural formula (a-2), a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, a polyester polymer charge transporting materials disclosed in Japanese Unexamined Patent Application Publication Nos. 8-176293 and 8-208820 may be used. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

From the viewpoints of facilitating the decrease in surface roughness of the charge transporting layer and further suppressing the occurrence of image deletion, a polycarbonate resin (a homopolymer of a bisphenol A, bisphenol Z, bisphenol C, or bisphenol TP or a copolymer thereof) may be used among the binder resins described above. The polycarbonate resins may be used alone or in combination. From the same viewpoints, a homopolymer-type polycarbonate resin of bisphenol Z may be contained among the polycarbonate resins.

The charge transporting layer may contain, in addition to the charge transporting material and the binder resin, inorganic particles, if needed.

When the charge transporting layer (in other words, the outermost layer of the organic photosensitive layer) contains inorganic particles, cracking of the inorganic surface layer is suppressed. Specifically, when a layer constituting the surface of the organic photosensitive layer contains inorganic particles, the inorganic particles function as a reinforcing material for the organic photosensitive layer; presumably thus, the organic photosensitive layer rarely deforms and cracking of the inorganic surface layer is suppressed. When the charge transporting layer (in other words, the organic photosensitive layer) contains inorganic particles, breakdown of the charge transporting layer (in other words, the organic photosensitive layer) rarely occurs even when the electric field intensity is high.

Examples of the inorganic particles used in the charge transporting layer include silica particles, alumina particles, titanium oxide particles, potassium titanate, tin oxide particles, zinc oxide particles, zirconium oxide particles, barium sulfate particles, calcium oxide particles, calcium carbonate particles, and magnesium oxide particles.

The inorganic particles may be one type or two or more types.

Among these, silica particles may be used since the dielectric loss factor is high, the electrical properties of the photoreceptor are rarely degraded, and occurrence of cracking in the inorganic surface layer is suppressed.

Silica particles suitable for the charge transporting layer will now be described in detail.

Examples of the silica particles include dry silica particles and wet silica particles.

Examples of the dry silica particles include pyrogenic silica (fumed silica) prepared by burning a silane compound, and deflagration silica particles prepared by deflagration of metal silicon powder.

Examples of the wet silica particles include wet silica particles obtained by neutralization reaction of sodium silicate and a mineral acid (precipitated silica synthesized and aggregated under alkaline conditions, gel silica particles synthesized and aggregated under acidic conditions, etc.), colloidal silica particles obtained by alkalifying and polymerizing acidic silicate (silica sol particles etc.), and sol-gel silica particles obtained by hydrolysis of an organic silane compound (for example, alkoxysilane).

Among these, pyrogenic silica particles having fewer silanol groups on the surface and a low gap structure may be used as the silica particles from the viewpoints of generation of residual potential, suppression of image defects caused by degradation of electrical properties (suppression of degradation of fine line reproducibility).

The silica particles may be surface-treated with a hydrophobizing agent. As a result, the number of silanol groups on the surfaces of the silica particles is decreased, and occurrence of residual potential is smoothly suppressed.

Examples of the hydrophobizing agent include known silane compounds such as chlorosilane, alkoxysilane, and silazane.

Among these, a silane compound having a trimethylsilyl group, a decylsilyl group, or a phenylsilyl group may be used as the hydrophobizing agent from the viewpoints of smoothly suppressing occurrence of residual potential and suppressing image density non-uniformity caused by charging non-uniformity of the photoreceptor surface. In other words, trimethylsilyl groups, decylsilyl groups or phenylsilyl groups may be present on the surfaces of the silica particles.

Examples of the silane compound (trimethylsilane compound) having trimethylsilyl groups include trimethylchlorosilane, trimethylmethoxysilane, and 1,1,1,3,3,3-hexamethyldisilazane.

Examples of the silane compound (decylsilane compound) having decylsilyl groups include decyltrichlorosilane, decyldimethylchlorosilane, and decyltrimethoxysilane.

Examples of the silane compound (phenylsilane compound) having phenylsilyl groups include triphenylmethoxysilane and triphenylchlorosilane.

The condensation ratio of hydrophobized silica particles (the ratio of Si—O—Si in the $SiO^{4-}$ bonds in the silica particles, hereinafter this ratio may be referred to as "condensation ratio of the hydrophobizing agent") is, for example, 90% or more, 91% or more, or 95% or more relative to the silanol groups on the surfaces of the silica particles.

When the condensation ratio of the hydrophobizing agent is within the above-described range, the number of silanol groups on the surfaces of the silica particles is decreased, and occurrence of residual potential is smoothly suppressed.

The condensation ratio of the hydrophobizing agent indicates the ratio of condensed silicon relative to all bondable sites of silicon in the condensed portions detected with nuclear magnetic resonance (NMR), and is measured as follows.

First, silica particles are separated from the layer. Separated silica particles are subjected to Si CP/MAS NMR analysis with AVANCE III 400 produced by Bruker, and the peak areas corresponding to the number of SiO substituents are determined. The values for the disubstituted ($Si(OH)_2(O—Si)_2$—), trisubstituted ($Si(OH)(O—Si)_3$—), and tetrasubstituted ($Si(O—Si)_4$—) are respectively assumed to be Q2, Q3, and Q4, and the condensation ratio of the hydrophobizing agent is calculated from the formula: $(Q2\times2+Q3\times3+Q4\times4)/4\times(Q2+Q3+Q4)$.

The volume resistivity of the silica particles is, for example, $10^{11}$ Ω·cm or more, and may be $10^{12}$ Ω·cm or more or $10^{13}$ Ω·cm or more.

When the volume resistivity of the silica particles is within the above-described range, degradation of the electrical properties is suppressed.

The volume resistivity of the silica particles is measured as follows. The measurement environment involves a temperature of 20° C. and a humidity of 50% RH.

First, silica particles are separated from the layer. Then, the measurement object, i.e., separated silica particles, is placed on a surface of a circular jig equipped with a 20 $cm^2$ electrode plate so that the silica particles form a silica particle layer having a thickness of about 1 mm or more and 3 mm or less. Another identical 20 $cm^2$ electrode plate is placed on the silica particle layer so as to sandwich the silica particle layer. In order to eliminate gaps between the silica particles, a load of 4 kg is applied onto the electrode plate on the silica particle layer, and then the thickness (cm) of the silica particle layer is measured. The electrodes above and under the silica particle layer are connected to an electrometer and a high-voltage power generator. A high voltage is applied to the two electrodes so that the electric field reaches a preset value, and the current value (A) that flows at this time is read so as to calculate the volume resistivity (Ω·cm) of the silica particles. The calculation formula of the volume resistivity (Ω·cm) of the silica particles is as follows.

Note that in the formula, ρ represents the volume resistivity (Ω·cm) of the silica particles, E represents the applied voltage (V), I represents the current value (A), I0 represents a current value (A) at an applied voltage of 0 V, and L represents the thickness (cm) of the silica particle layer. For evaluation, the volume resistivity at an applied voltage of 1000 V is used.

$$\rho=E\times20/(I-I0)/L \quad \text{Formula:}$$

The volume-average particle diameter of the inorganic particles including the silica particles is, for example, 20 nm or more and 200 nm or less, may be 40 nm or more and 150 nm or less, may be 50 nm or more and 120 nm or less, or may be 50 nm or more and 110 nm or less.

When the volume-average particle diameter is within the above-describe range, cracking of the inorganic surface layer and occurrence of the residual potential are smoothly suppressed.

The volume-average particle diameter of the silica particles is measured as follows. In the description below, the method for measuring the silica particles is described but the same measurement method is employed for other particles also.

The volume-average particle diameter of the silica particles is measured by separating the silica particles from the layer, observing 100 primary particles of these silica particles with a scanning electron microscope (SEM) at a magnification of 40000, measuring the longest axis and the shortest axis of each particle by image analysis of the primary particles, and measuring the sphere-equivalent diameter from the intermediate values. The 50% diameter (D50v) in the cumulative frequency of the obtained sphere-equivalent diameters is determined, and assumed to be the volume-average particle diameter of the silica particles.

The amount of the inorganic particles contained may be determined as appropriate for the type of the inorganic particles. From the viewpoints of smoothly suppressing cracking of the inorganic surface layer and occurrence of the residual potential, the amount may be, for example, 30 mass % or more, 40 mass % or more, 50 mass % or more, or 55 mass % or more relative to the entire charge transporting layer (solid content).

The upper limit of the amount of the inorganic particles contained is not particularly limited. From the viewpoint of obtaining the properties of the charge transporting layer, etc., the amount may be 90 mass % or less, 80 mass % or less, 70 mass % or less, or 65 mass % or less.

The amount of the inorganic particles contained may be larger than the amount of the charge transporting material contained. For example, the amount of the inorganic particles may be 55 mass % or more and 90 mass % or less relative to the entire charge transporting layer (solid content).

The charge transporting layer may contain other known additives.

Properties of Charge Transporting Layer

The surface roughness Ra (arithmetic average surface roughness Ra) of the charge transporting layer measured at a surface on the inorganic surface layer side is, for example, 0.06 μm or less, may be 0.03 μm or less, or may be 0.02 μm or less.

When the surface roughness Ra is within the above-described range, the flatness and smoothness of the inorganic surface layer are enhanced, and the cleaning properties are improved.

In order to adjust the surface roughness Ra to be within the above-described range, for example, the thickness of the layer may be increased.

The surface roughness Ra is measured as follows.

First, after the inorganic surface layer is removed, the layer to be measured is exposed. Then a portion of that layer is cut with a cutter or the like to obtain a measurement sample.

A stylus-type surface roughness meter (SURFCOM 1400A produced by TOKYO SEIMITSU CO., LTD., for example) is used to measure the measurement sample. The measurement conditions are set according to JIS B 0601-1994 with evaluation length Ln=4 mm, reference length L=0.8 mm, and cut-off value=0.8 mm.

The elastic modulus of the charge transporting layer is, for example, 5 GPa or more, may be 6 GPa or more, or may be 6.5 GPa or more.

When the elastic modulus of the charge transporting layer is within the above-describe range, cracking of the inorganic surface layer is smoothly suppressed.

In order to adjust the elastic modulus of the charge transporting layer to be within the above-described range, for example, the particle diameter and the amount of the silica particles may be adjusted, or the type and the amount of the charge transporting material may be adjusted.

The elastic modulus of the charge transporting layer is measured as follows.

First, after the inorganic surface layer is removed, the layer to be measured is exposed. Then a portion of that layer is cut with a cutter or the like to obtain a measurement sample.

A depth profile of this measurement sample is obtained by continuous stiffness measurement (CSM) (U.S. Pat. No. 4,848,141) by using Nano Indenter SA2 produced by MTS Systems Corporation, and the average of the values observed at an indentation depth of 30 nm to 100 nm is used for measurement.

The thickness of the charge transporting layer is, for example, 10 μm or more and 40 μm or less, may be 10 μm or more and 35 μm or less, or may be 15 μm or more and 30 μm or less.

When the thickness of the charge transporting layer is within the above-describe range, cracking of the inorganic surface layer and occurrence of the residual potential are smoothly suppressed.

Formation of Charge Transporting Layer

The charge transporting layer may be formed by any known method. For example, a coating film is formed by using a charge-transporting-layer-forming solution prepared by adding the above-mentioned components to a solvent, dried, and, if needed, heated.

Examples of the solvent used to prepare the charge-transporting-layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge-transporting-layer-forming solution to the charge generating layer include common methods such as a blade coating method, a wire bar coating method, a spray coating method, a dip coating method, a bead coating method, an air knife coating method, and a curtain coating method.

When particles (for example, silica particles or fluororesin particles) are to be dispersed in the charge-transporting-layer-forming solution, a dispersing method that uses, for example, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is employed. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

After formation of the charge transporting layer and before formation of the inorganic surface layer, a step of substituting air, which is contained in the organic photosensitive layer formed on the conductive substrate, with a gas having a higher oxygen concentration than the air may be performed as needed.

Inorganic Surface Layer

Composition of Inorganic Surface Layer

The inorganic surface layer is a layer that contains an inorganic material containing a group 13 element and oxygen.

Examples of the inorganic material containing the group 13 element and oxygen include metal oxides such as gallium oxide, aluminum oxide, indium oxide, and boron oxide, and mixed crystals thereof.

Among these, gallium oxide may be used as the inorganic material since gallium oxide has excellent mechanical strength and translucency, the n-conductivity type, and excellent conduction controllability.

The inorganic surface layer is to contain at least a group 13 element (for example, gallium) and oxygen, and may contain hydrogen as needed. When hydrogen is contained, physical properties of the inorganic surface layer containing at least the group 13 element (for example, gallium) and oxygen can be easily controlled. For example, in an inorganic surface layer containing gallium, oxygen, and hydrogen (for example, an inorganic surface layer composed of hydrogen-containing gallium oxide), the volume resistivity can be easily controlled within the range of $10^9$ Ω·cm or more and $10^{14}$ Ω·cm or less when the compositional ratio [O]/[Ga] is changed from 1.0 to 1.5.

In particular, the inorganic surface layer may contain a group 13 element, oxygen, and hydrogen, and the sum of the element compositional percentages of the group 13 element, oxygen, and hydrogen relative to all elements constituting the inorganic surface layer may be 90 atom % or more.

The element compositional ratio (oxygen/group 13 element) of oxygen to the group 13 element may be 1.0 or more and less than 1.5, may be 1.03 or more and 1.47 or less, may be 1.05 or more and 1.45 or less, or may be 1.10 or more and 1.40 or less.

When the element compositional ratio (oxygen/group 13 element) of the material constituting the inorganic surface layer is within the above-described range, image defects caused by scratches on the surface of the photoreceptor are suppressed, affinity to the fatty acid metal salt supplied to the surface of the photoreceptor is improved, and contamination in the apparatus by the fatty acid metal salt is suppressed. From the same viewpoints, the group 13 element may be gallium.

When the sum of the element compositional percentages of the group 13 element (especially gallium), oxygen, and hydrogen relative to all elements constituting the inorganic surface layer is 90 atom % or more, for example, and when a group 15 element, such as N, P, or As, and the like are mixed in, the effect of mixed-in elements bonding with the group 13 element (especially gallium) is suppressed, and the appropriate range can be easily found for the compositional ratio (oxygen/group 13 element (especially gallium)) of oxygen to the group 13 element (especially gallium), which can improve hardness and electrical properties of the inorganic surface layer. The sum of the element compositional percentages may be 95 atom % or more, may be 96 atom % or more, or 97 atom % or more from the above-described viewpoints.

The inorganic surface layer may contain, in addition to the inorganic material described above, at least one element selected from C, Si, Ge, and Sn to control the conductivity type to the n-type. For the p-type, at least one element selected from N, Be, Mg, Ca, and Sr may be contained, for example.

When the inorganic surface layer is configured to contain gallium, oxygen, and, if needed, hydrogen, possible element compositional percentages are as follows from the viewpoint of excellent mechanical strength, translucency, flexibility, and conduction controllability:

The element compositional percentage for gallium relative to all elements constituting the inorganic surface layer is, for example, 15 atom % or more and 50 atom % or less, may be 20 atom % or more and 40 atom % or less, or may be 20 atom % or more and 30 atom % or less.

The element compositional percentage for oxygen relative to all elements constituting the inorganic surface layer is, for example, 30 atom % or more and 70 atom % or less, may be 40 atom % or more and 60 atom % or less, or may be 45 atom % or more and 55 atom % or less.

The element compositional percentage for hydrogen relative to all elements constituting the inorganic surface layer is, for example, 10 atom % or more and 40 atom % or less, may be 15 atom % or more and 35 atom % or less, or may be 20 atom % or more and 30 atom % or less.

The element compositional percentages, ratios of the number of atoms, etc., of the elements in the inorganic surface layer, as well as the distribution in the thickness direction, are determined by Rutherford back-scattering (hereinafter, referred to as "RBS").

In RBS, 3SDH Pelletron produced by National Electrostatics Corp., is used as an accelerator, RBS-400 produced by CE&A is used as an end station, and 3S-R10 is used as the system. HYPRA program produced by CE&A etc., are used for analysis.

Regarding the RBS measurement conditions, He++ ion beam energy is 2.275 eV, detection angle is 160°, and the grazing angle with respect to the incident beam is about 109°.

The specific procedure for RBS measurement is as follows.

First, a He++ ion beam is applied perpendicular to the sample, the detector is set at 160° with respect to the ion beam, and back-scattered He signals are measured. The compositional ratio and the film thickness are determined from the detected He energy and intensity. In order to improve accuracy of determining the compositional ratio and the film thickness, the spectrum may be measured by using two detection angles. The accuracy is improved by measuring at two detection angles of different resolutions in the depth direction or different back-scattering dynamics, and cross-checking the results.

The number of He atoms back-scattered by the target atoms is determined solely by three factors: 1) the atomic number of the target atoms, 2) the energy of the He atoms before scattering, and 3) the scattering angle.

The density is assumed from the measured composition by calculation, and the assumed value of density is used to calculate the thickness. The error in density is within 20%.

The element compositional percentage for hydrogen is determined by hydrogen forward scattering (hereinafter, referred to as "HFS").

In HFS measurement, 3SDH Pelletron produced by National Electrostatics Corp., is used as an accelerator, RBS-400 produced by CE&A is used as an end station, and 3S-R10 is used as the system. HYPRA program produced by CE&A is used for analysis. The HFS measurement conditions are as follows.

He++ ion beam energy: 2.275 eV

Detection angle: 160°

Grazing angle with respect to incident beam: 30°

In HFS measurement, the detector is set at 30° with respect to the He++ ion beam, and the sample is set at 75° with respect to the normal line so as to pick up signals from hydrogen scattered forward from the sample. During this process, the detector may be covered with an aluminum foil to remove He atoms that scatter along with the hydrogen atoms. The quantitative determination is carried out by normalizing the hydrogen counts from reference samples and the measurement sample with a stopping power, and then comparing the results. As the reference samples, a sample prepared by ion-implanting H into Si, and white mica are used.

White mica is known to have a hydrogen concentration of 6.5 atom %.

For H atoms adsorbing the outermost surface, for example, correction is implemented by subtracting the amount of H adsorbing a clean Si surface.

The inorganic surface layer may have a distribution of compositional ratio in the thickness direction or may have a multilayer structure, depending on the purpose.

Properties of Inorganic Surface Layer

The surface roughness Ra (arithmetic average surface roughness Ra) of the outer circumferential surface (in other words, the surface of an electrophotographic photoreceptor 7) of the inorganic surface layer is, for example, 5 nm or less, maybe 4.5 nm or less, or may be 4 nm or less.

When the surface roughness Ra is within the above-described range, charging non-uniformity is suppressed.

In order to adjust the surface roughness Ra to be within the above-described range, for example, the surface roughness Ra of the charge transporting layer measured at a surface on the inorganic surface layer side may be adjusted to be within the above-described range.

Measurement of the surface roughness Ra of the outer circumferential surface of the inorganic surface layer involves the same method as the measurement of the surface roughness Ra of the charge transporting layer at a surface on the inorganic surface layer side except for that the outer circumferential surface of the inorganic surface layer is directly measured.

The volume resistivity of the inorganic surface layer may be $5.0\times10^{7}$ Ω·cm or more and less than $1.0\times10^{12}$ Ω·cm. From the viewpoints of facilitating suppression of occurrence of image deletion and image defects caused by scratches on the surface of the photoreceptor, the volume resistivity of the inorganic surface layer may be $8.0\times10^{7}$ Ω·cm or more and $7.0\times10^{11}$ Ω·cm or less, may be $1.0\times10^{8}$ Ω·cm or more and $5.0\times10^{11}$ Ω·cm or less, or may be $5.0\times10^{8}$ Ω·cm or more and $2.0\times10^{11}$ Ω·cm or less.

The volume resistivity is determined by calculation from a resistance value measured with LCR meter ZM2371 produced by NF Corporation at a frequency of 1 kHz and a voltage of 1 V, and on the basis of the electrode area and the sample thickness.

The measurement sample may be a sample obtained by forming a film on an aluminum substrate under the same conditions as those for forming the inorganic surface layer to be measured, and forming a gold electrode on the formed film by vacuum vapor deposition. Alternatively, the measurement sample may be a sample prepared by separating the inorganic surface layer from the already prepared electrophotographic photoreceptor, etching some part of the inorganic surface layer, and interposing the etched layer between a pair of electrodes.

The inorganic surface layer may be a non-single-crystal film such as a microcrystalline film, a polycrystal film, or an amorphous film. Among these, an amorphous film may be used for its flatness and smoothness, and a microcrystalline film may be used from the viewpoint of hardness.

The growth section of the inorganic surface layer may have a columnar structure; however, from the viewpoint of slippage, a structure having high flatness may be employed, or an amorphous structure may be employed.

The crystallinity and amorphousness are identified by the absence or presence of dots and lines in a diffraction image obtained by reflection high energy electron diffraction (RHEED) measurement.

The elastic modulus of the inorganic surface layer may be 30 GPa or more and 80 GPa or less, or may be 40 GPa or more and 65 GPa or less.

When the elastic modulus is within the above-described range, occurrence of recesses (dents), separation, and cracking in the inorganic surface layer is smoothly suppressed.

The elastic modulus is determined by obtaining a depth profile by continuous stiffness measurement (CSM) (U.S. Pat. No. 4,848,141) by using Nano Indenter SA2 produced by MTS Systems Corporation, and determining the average of the values observed at an indentation depth of 30 nm to 100 nm.

The measurement conditions are as follows.

Measurement environment: 23° C., 55% RH

Indenter used: regular three-sided pyramid indenter composed of diamond (Berkovic indenter)

Test mode: CSM mode

The measurement sample may be a sample obtained by forming a film on a substrate under the same conditions as those for forming the inorganic surface layer to be measured, or may be a sample prepared by separating the inorganic surface layer from the already prepared electrophotographic photoreceptor and etching some part of the inorganic surface layer.

The thickness of the inorganic surface layer is, for example, 0.2 μm or more and 10.0 μm or less or may be 0.4 μm or more and 5.0 μm or less.

When the thickness is within the above-described range, occurrence of recesses (dents), separation, and cracking in the inorganic surface layer is smoothly suppressed.

Formation of Inorganic Surface Layer

The inorganic surface layer is formed by, for example, a gas-phase film forming method such as a plasma chemical vapor deposition (CVD) method, an organic metal gas-phase growth method, a molecular beam epitaxy method, a vapor deposition method, or a sputtering method.

Formation of the inorganic surface layer will now be described through specific examples with reference to the drawing illustrating an example of the film forming apparatus. Although the description below is directed to a method for forming an inorganic surface layer containing gallium, oxygen, and hydrogen, the method is not limited to this, and any known forming method may be applied depending on the composition of the inorganic surface layer to be obtained.

Figure 4A:
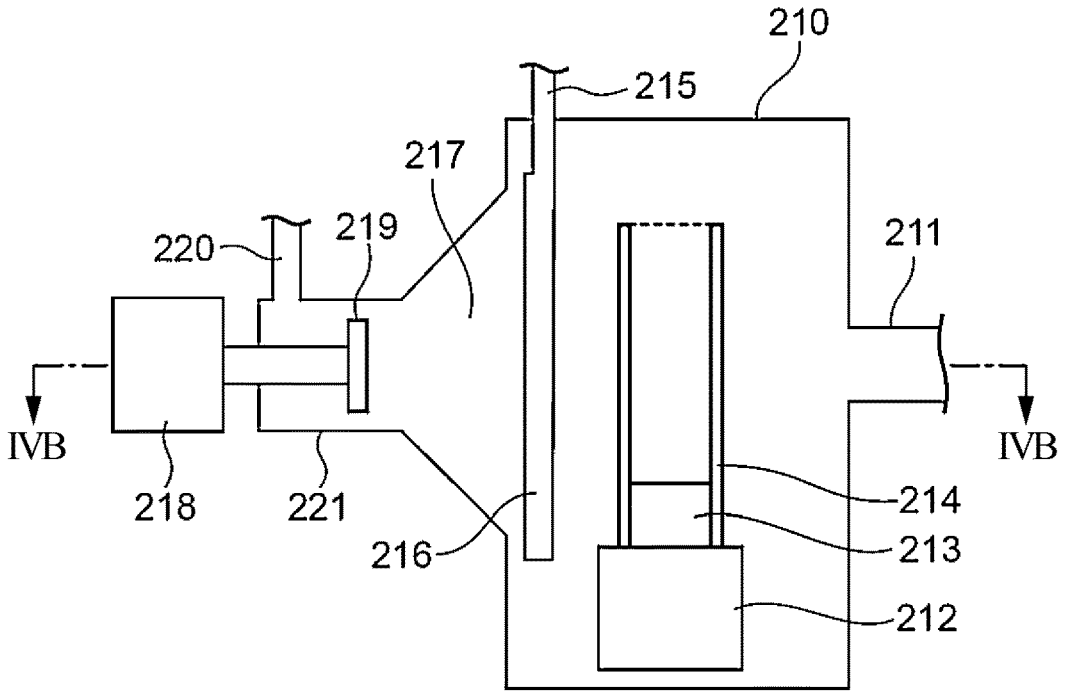
FIGS. 4A and 4B are each a schematic diagram illustrating one example of a film forming device used to form an inorganic protective layer of the electrophotographic photoreceptor of the exemplary embodiment.
Figure 4B:
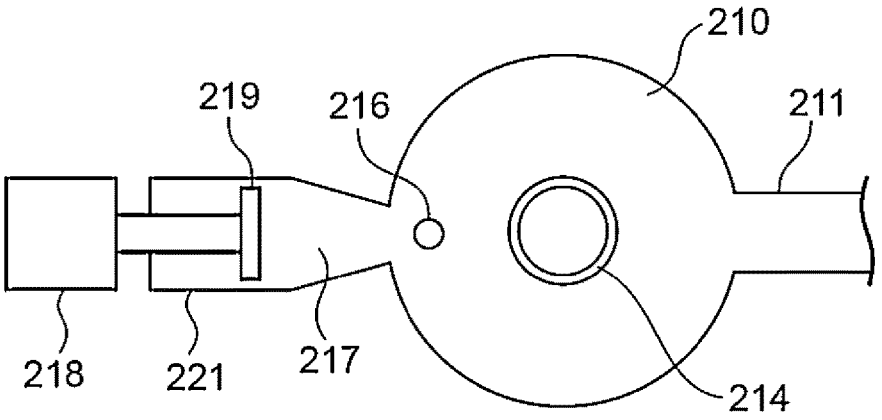

FIGS. 4A and 4B are each a schematic diagram illustrating one example of a film-forming apparatus used to form an inorganic surface layer of the electrophotographic photoreceptor of the exemplary embodiment. FIG. 4A is a schematic sectional view of the film forming apparatus viewed from the side, and FIG. 4B is a schematic sectional view of the film forming apparatus illustrated in FIG. 4A taken along line IVB-IVB. In FIG. 4, reference numeral 210 denotes a deposition chamber, 211 denotes an exhaust port, 212 denotes a substrate rotating portion, 213 denotes a substrate supporting member, 214 denotes a substrate, 215 denotes a gas inlet duct, 216 denotes a shower nozzle having an opening through which gas, which is introduced from the gas inlet tube 215, is jet out, 217 denotes a plasma diffusing section, 218 denotes a high-frequency power supply unit, 219 denotes a flat plate electrode, 220 denotes a gas inlet duct, and 221 denotes a high-frequency discharge tube portion.

In the film forming apparatus illustrated in FIGS. 4A and 4B, the exhaust port 211 connected to a vacuum evacuator (not illustrated) is installed on one end of the deposition chamber 210. A plasma generator constituted by the high-frequency power supply unit 218, the flat plate electrode 219, and the high-frequency discharge tube portion 221 is installed on the side opposite to the side where the exhaust port 211 of the deposition chamber 210 is formed.

This plasma generator is constituted by the high-frequency discharge tube portion 221, the flat plate electrode 219 installed inside the high-frequency discharge tube portion 221 and having a discharge surface provided on the exhaust port 211 side, and the high-frequency power supply unit 218 installed outside the high-frequency discharge tube portion 221 and connected to the surface of the flat plate electrode 219 opposite of the discharge surface. The gas inlet duct 220 for supplying gas into the interior of the high-frequency discharge tube portion 221 is connected to the high-frequency discharge tube portion 221, and the other end of the gas inlet duct 220 is connected to a first gas supply source not illustrated in the drawing.

Figure 5:
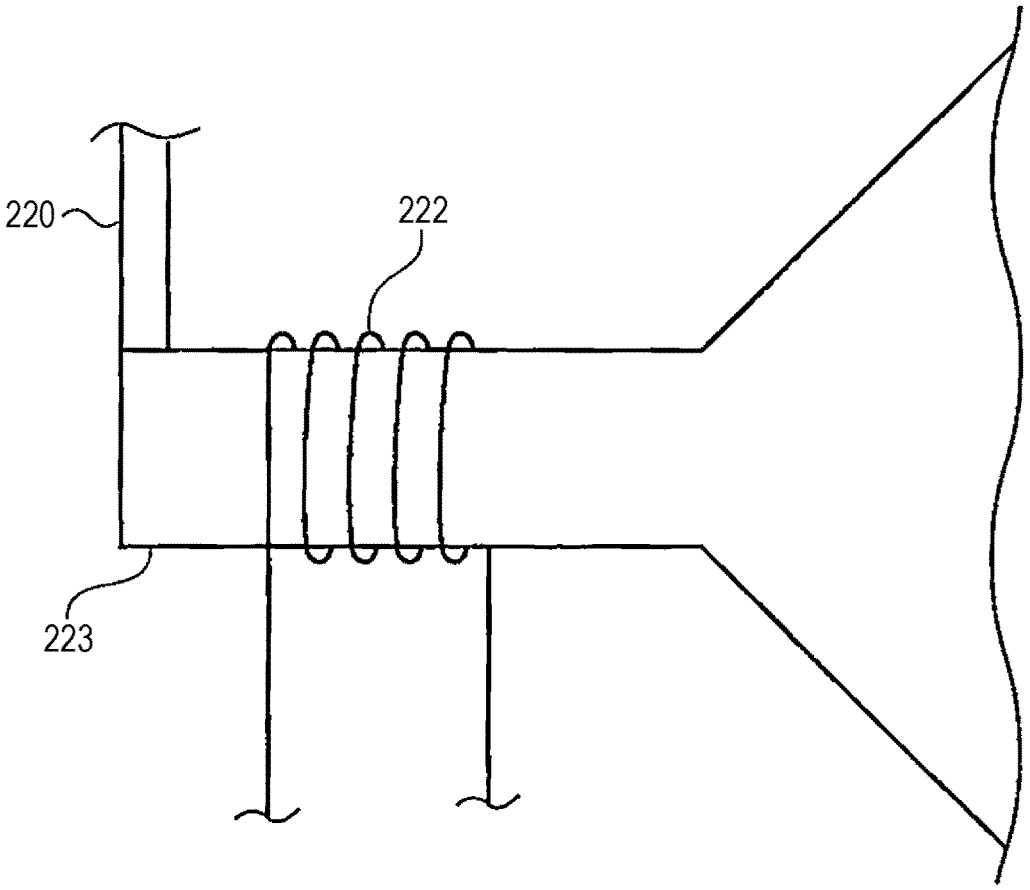
FIG. 5 is a schematic diagram illustrating an example of a plasma generator used to form an inorganic protective layer of the electrophotographic photoreceptor of the exemplary embodiment.

Instead of the plasma generator installed in the film forming apparatus illustrated in FIGS. 4A and 4B, a plasma generator illustrated in FIG. 5 may be used. FIG. 5 is a schematic diagram illustrating another example of the plasma generator used in the film forming apparatus illustrated in FIGS. 4A and 4B, and is a side view of the plasma generator. In FIG. 5, reference numeral 222 denotes a high-frequency coil, 223 denotes a quartz tube, and 220 denotes the same part as that illustrated in FIGS. 4A and 4B. The plasma generator is constituted by the quartz tube 223 and the high-frequency coil 222 installed along the outer circumferential surface of the quartz tube 223. One end of the quartz tube 223 is connected to the deposition chamber 210 (not illustrated in FIG. 5). The other end of the quartz tube 223 is connected to the gas inlet duct 220 through which gas is introduced into the quartz tube 223.

In FIGS. 4A and 4B, a rod-shaped shower nozzle 216 extending along the discharge surface is connected to the discharge surface side of the flat plate electrode 219, one end of the shower nozzle 216 is connected to the gas inlet duct 215, and the gas inlet duct 215 is connected to a second gas supply source (not illustrated in the drawing) disposed outside the deposition chamber 210.

In the deposition chamber 210, the substrate rotating portion 212 is installed. A cylindrical substrate 214 is attachable to the substrate rotating portion 212 via the substrate supporting member 213 so that the longitudinal direction of the shower nozzle 216 and the axis direction of the substrate 214 face each other. In forming the film, the substrate rotating portion 212 is rotated so that the substrate 214 is rotated in the circumferential direction. For example, a photoreceptor including layers up to the organic photosensitive layer prepared in advance is used as the substrate 214.

The inorganic surface layer is formed as follows, for example.

First, oxygen gas (or helium (He)-diluted oxygen gas), helium (He) gas, and, if needed, hydrogen ($H_2$) gas are introduced into the high-frequency discharge tube portion 221 from the gas inlet duct 220, and 13.56 MHz radio waves are supplied to the flat plate electrode 219 from the high-frequency discharge tube portion 218. During this process, the plasma diffusing section 217 is formed so as to radially spread from the discharge surface side of the flat plate electrode 219 toward the exhaust port 211 side. The gas introduced from the gas inlet duct 220 flows in the deposition chamber 210 from the flat plate electrode 219 side toward the exhaust port 211 side. The flat plate electrode 219 may be surrounded by an earth shield.

Next, trimethylgallium gas is introduced into the deposition chamber 210 through the gas inlet duct 215 and the shower nozzle 216 located downstream of the flat plate electrode 219, which is an activating device, so as to form a non-single-crystal film that contains gallium, oxygen, and hydrogen on the surface of the substrate 214.

For example, a substrate having an organic photosensitive layer is used as the substrate 214.

The temperature of the surface of the substrate 214 during formation of the inorganic surface layer may be 150° C. or lower, may be 100° C. or lower, or may be 30° C. or higher and 100° C. or lower since an organic photoreceptor having an organic photosensitive layer is used.

Even when the temperature of the surface of the substrate 214 is 150° C. or lower at the time the film formation is started, the temperature may rise to 150° C. or higher due to plasma. In such a case, the organic photosensitive layer may be damaged by heat. Thus, the surface temperature of the substrate 214 may be controlled by considering this possibility.

The temperature of the surface of the substrate 214 may be controlled by using one or both of a heating unit and a cooling unit (not illustrated in the drawing), or may be left to naturally rise during the process of discharging. When the substrate 214 is to be heated, a heater may be installed on the inner or outer side of the substrate 214. When the substrate 214 is to be cooled, a gas or liquid for cooling may be circulated on the inner side of the substrate 214.

In order to avoid elevation of the temperature of the surface of the substrate 214 due to discharging, it is effective to adjust the high-energy gas flow applied to the surface of the substrate 214. In such a case, conditions such as the gas flow rate, the discharge output, and the pressure are adjusted so as to achieve the desirable temperature.

In addition, an organic metal compound containing aluminum or a hydride such as diborane can be used instead of trimethylgallium gas, and two or more of such materials may be mixed and used.

For example, in the initial stage of forming the inorganic surface layer, trimethylindium is introduced into the deposition chamber 210 through the gas inlet duct 215 and the shower nozzle 216 so as to form a film containing nitrogen and indium on the substrate 214. This film absorbs ultraviolet light, which is generated when film formation is continued and which deteriorates the organic photosensitive layer. Thus, damage on the organic photosensitive layer due to generation of ultraviolet light during film formation is suppressed.

Regarding the doping method using a dopant during film formation, $SiH_3$ or $SnH_4$ in a gas state is used for the n-type, and biscyclopentadienylmagnesium, dimethylcalcium, dimethylstrontium, or the like in a gas state is used for the p-type. In order to dope the surface layer with a dopant element, a known method, such as a thermal diffusion method or an ion implantation method, may be employed.

Specifically, for example, gas containing at least one dopant element is introduced into the deposition chamber 210 through the gas inlet duct 215 and the shower nozzle 216 so as to obtain an inorganic surface layer of an n- or p-conductivity type.

For the film forming apparatus illustrated in FIGS. 4A, 4B, and 5, active nitrogen or active hydrogen formed by discharge energy may be independently controlled by installing multiple activation devices, or gas containing both nitrogen and hydrogen atoms, such as $NH_3$, may be used. Furthermore, $H_2$ may be added. The conditions under which active hydrogen are liberated and generated from the organic metal compound may be employed.

In this manner, carbon atoms, gallium atoms, nitrogen atoms, hydrogen atoms, etc., that have been activated exist in a controlled state on the surface of the substrate 214. The activated hydrogen atoms have an effect of causing desorption of hydrogen atoms in the hydrocarbon groups, such as methyl groups and ethyl groups, constituting the organic metal compound, the hydrogen atoms taking the form of molecules.

Thus, a hard film (inorganic surface layer) having three-dimensional bonds is formed.

The plasma generators for the film forming apparatus illustrated in FIGS. 4A, 4B, and 5 use a high-frequency oscillator. However, the plasma generator is not limited to this. For example, a microwave oscillator may be used, or an electrocyclotron resonance-type or helicon plasma-type apparatus may be used. The high-frequency oscillator may be of an induction type or of a capacitance type.

Two or more of these devices may be used in combination, or two or more of the same type of devices may be used in combination. In order to suppress temperature elevation of the surface of the substrate 214 due to plasma irradiation, a high-frequency oscillator may be used. Alternatively, a device that suppresses application of heat may be provided.

When two or more different types of plasma generators (a plasma generating unit) are used, discharging may be cause to occur simultaneously at the same pressure. Alternatively, the difference in pressure may be created between a region where discharging occurs and a region where film formation is performed (portion where the substrate is installed). These devices may be arranged in series in the film forming apparatus with respect to the gas flow formed from the portion where the gas is introduced toward the portion where the gas is discharged. Alternatively, all of the devices may be arranged to oppose the film-forming surface of the substrate.

For example, when two types of plasma generators are arranged in series with respect to the gas flow, the film forming apparatus illustrated in FIGS. 4A and 4B is used as a second plasma generator that induces discharging in the deposition chamber 210 by using the shower nozzle 216 as the electrode. In such a case, for example, a high-frequency voltage is applied to the shower nozzle 216 via the gas inlet duct 215 so as to allow discharging in the deposition chamber 210 using the shower nozzle 216 as the electrode. Alternatively, instead of using the shower nozzle 216 as the electrode, a cylindrical electrode may be provided between the substrate 214 and the flat plate electrode 219 in the deposition chamber 210, and discharging may be caused to occur in the deposition chamber 210 by using the cylindrical electrode.

When two different plasma generators are used at the same pressure, for example, when a microwave oscillator and a high-frequency oscillator are used, the excitation energy of the excited species can be significantly changed, and thus this is effective for controlling the quality of the film. Discharging may be performed at a pressure near the atmospheric air pressure (70000 Pa or more and 110000 Pa or less). When discharging is to be performed at a pressure near the atmospheric air pressure, He may be used as the carrier gas.

The inorganic surface layer is formed by, for example, installing the substrate 214, which is prepared by forming an organic photosensitive layer on a substrate, in the deposition chamber 210 and introducing mixed gases having different compositions.

Regarding the film forming conditions, for example, when discharging is performed by high-frequency discharging, the frequency may be in the range of 10 kHz or more and 50 MHz or less in order to perform high-quality film formation at low temperature. The output depends on the size of the substrate 214, but the output may be in the range of 0.01 $W/cm^2$ or more and 0.2 $W/cm^2$ or less relative to the surface area of the substrate. The speed of rotation of the substrate 214 may be in the range of 0.1 rpm or more and 500 rpm or less.

Single-Layer-Type Photosensitive Layer

The single-layer-type photosensitive layer (charge generating/charge transporting layer) is, for example, a layer that contains a charge generating material, a charge transporting material, and, if needed, a binder resin and other known additives. These materials are the same as those described for the charge generating layer and the charge transporting layer.

The amount of the charge generating material contained in the single-layer-type photosensitive layer relative to the total solid content may be 0.1 mass % or more and 10 mass % or less, or may be 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer or the charge transporting layer.

The thickness of the single-layer-type photosensitive layer is, for example, 5 μm or more and 50 μm or less or may be 10 μm or more and 40 μm or less.

Charging Device

The charging device 15 charges the surface of the photoreceptor 12. The charging device 15 is equipped with a charging member 14 that is in contact or non-contact with the surface of the photoreceptor 12 and that charges the surface of the photoreceptor 12; and a power supply 28 (one example of the voltage applying portion for the charging member) that applies a charging voltage to the charging member 14. The power supply 28 is electrically coupled to the charging member 14.

Examples of the charging member 14 of the charging device 15 include contact-type chargers such as conductive charging rollers, charging brushes, charging films, charging rubber blades, and charging tubes. Other examples of the charging member 14 include known chargers such as non-contact-type roller chargers, and scorotron charges and corotron chargers that utilize corona discharge.

When the charging device is equipped with a charging roller that charges the photoreceptor by contact, contamination of the surface of the charging roller with the fatty acid metal salt is likely to occur. However, according to the image forming apparatus of the exemplary embodiment, because the inorganic surface layer containing the group 13 element and oxygen is provided, detachment of the fatty acid metal salt from the photoreceptor surface is presumably suppressed due to high affinity of the fatty acid metal salt. As a result, even when the amount of the fatty acid metal salt supplied is increased so that the coverage by the metal derived from the fatty acid metal salt exceeds 40%, contamination of the surface of the charging roller by the fatty acid metal salt is suppressed.

Electrostatic Image Forming Device

The electrostatic image forming device 16 forms an electrostatic image on the charged surface of the photoreceptor 12. Specifically, for example, the electrostatic image forming device 16 applies, to the surface of the photoreceptor 12 charged by the charging member 14, light L modified on the basis of the image information of the image to be formed so as to form an electrostatic image corresponding to the image of the image information on the photoreceptor 12.

An example of the electrostatic image forming device 16 is an optical device that has a light source that can apply light, such as semiconductor laser light, LED light, or liquid crystal shutter light, into an image shape.

Developing Device

The developing device 18 is, for example, disposed downstream of the position irradiated with light L from the electrostatic image forming device 16 in the rotation direction of the photoreceptor 12. A container that contains a developer is installed in the developing device 18. The container contains an electrostatic image developer that contains a toner. The toner in a charged state is, for example, contained in the developing device 18.

In the image forming apparatus illustrated in FIG. 1, particles of fatty acid metal salt are added to the developer (the toner therein) contained in the developing device 18; in other words, the developing device 18 also serves as a supply device that supplies the fatty acid metal salt to the contact portion between the surface of the photoreceptor 12 and the cleaning blade 22A.

The details of the particles of the fatty acid metal salt added to the developer (the toner therein) are described below.

The developing device 18 is equipped with a developing member 18A that develops the electrostatic image on the surface of the photoreceptor 12 by using a toner-containing developer, and a power supply 32 that applies a developing voltage to the developing member 18A. The developing member 18A is, for example, electrically coupled to the power supply 32.

The developing member 18A of the developing device 18 is selected according to the type of the developer, and an example thereof is a developing roller that has a developing sleeve with a built-in magnet.

The developing device 18 (including the power supply 32) is electrically coupled to the control device 36 in the image forming apparatus 10, and is driven and controlled by the control device 36 so as to apply the developing voltage to the developing member 18A. The developing member 18A to which the developing voltage is applied is charged to the developing potential corresponding to the developing voltage. The developing member 18A charged to the charging potential retains, on the surface thereof, the developer contained in the developing device 18 and supplies the toner contained in the developer from the inside of the developing device 18 to the surface of the photoreceptor 12. The electrostatic image formed on the surface of the photoreceptor 12 supplied with the toner is developed into a toner image.

Transfer Device

The transfer device 31 is, for example, disposed downstream of the position where the developing member 18A is installed in the rotation direction of the photoreceptor 12. The transfer device 31 is equipped with, for example, a transfer member 20 that transfers the toner image on the surface of the photoreceptor 12 onto a recording medium 30A, and a power supply 30 that applies a transfer voltage to the transfer member 20. The transfer member 20 has, for example, a cylindrical shape, and rotates along the direction indicated by the arrow B1. The recording medium 30A is sandwiched between the transfer member 20 and the photoreceptor 12 and carried. The transfer member 20 is, for example, electrically coupled to the power supply 30.

Examples of the transfer member 20 include contact-type transfer chargers that use belts, rollers, films, rubber cleaning blades, etc., and known non-contact-type transfer chargers such as scorotron transfer chargers and corotron transfer chargers that utilize corona discharge.

The transfer device 31 (including the power supply 30) is, for example, electrically coupled to the control device 36 in the image forming apparatus 10, and is driven and controlled by the control device 36 so as to apply the transfer voltage to the transfer member 20. The transfer member 20 to which the transfer voltage is applied is charged to the transfer potential corresponding to the transfer voltage.

When the transfer voltage, which has an opposite polarity from the toner constituting the toner image on the photoreceptor 12, is applied from the power supply 30 of the transfer member 20 to the transfer member 20, for example, a transfer electric field intense enough to electrostatically transfer the toner constituting the toner image from the photoreceptor 12 to the transfer member 20 side is formed in a region where the photoreceptor 12 and the transfer member 20 oppose each other (refer to the transfer region 32A illustrated in FIG. 1).

The recording medium 30A is, for example, contained in the container (not illustrated in the drawing), is fed along a feed path 34 by multiple feeding members (not illustrated in the drawing), and reaches the transfer region 32A, which is the region where the photoreceptor 12 and the transfer member 20 oppose each other. In the example illustrated in FIG. 1, the recording medium is fed in the arrow B2 direction. When the recording medium 30A arrives at the transfer region 32A, for example, the toner image on the photoreceptor 12 is transferred onto the recording medium 30A by the transfer electric field formed in the region by applying the transfer voltage to the transfer member 20. In other words, the toner image is transferred onto the recording medium 30A as the toner moves from the surface of the photoreceptor 12 to the recording medium 30A. As a result, the toner image on the photoreceptor 12 is transferred onto the recording medium 30A by the transfer electric field.

Cleaning Device

The cleaning device 22 is disposed downstream of the transfer region 32A in the rotation direction of the photoreceptor 12. After the toner image is transferred onto the recording medium 30A, the cleaning device 22 cleans the residual toner attached to the photoreceptor 12. The cleaning device 22 also cleans the attaching matters, such as paper powder, in addition to the residual toner.

The cleaning device 22 is equipped with a cleaning blade 22A, and the attaching matters on the surface of the photoreceptor 12 are removed by orienting the tip of the cleaning blade 22A in a direction that opposes the rotation direction of the photoreceptor 12 and bringing the tip into contact with the surface.

The cleaning device 22 will now be described with reference to FIG. 3.

Figure 3:
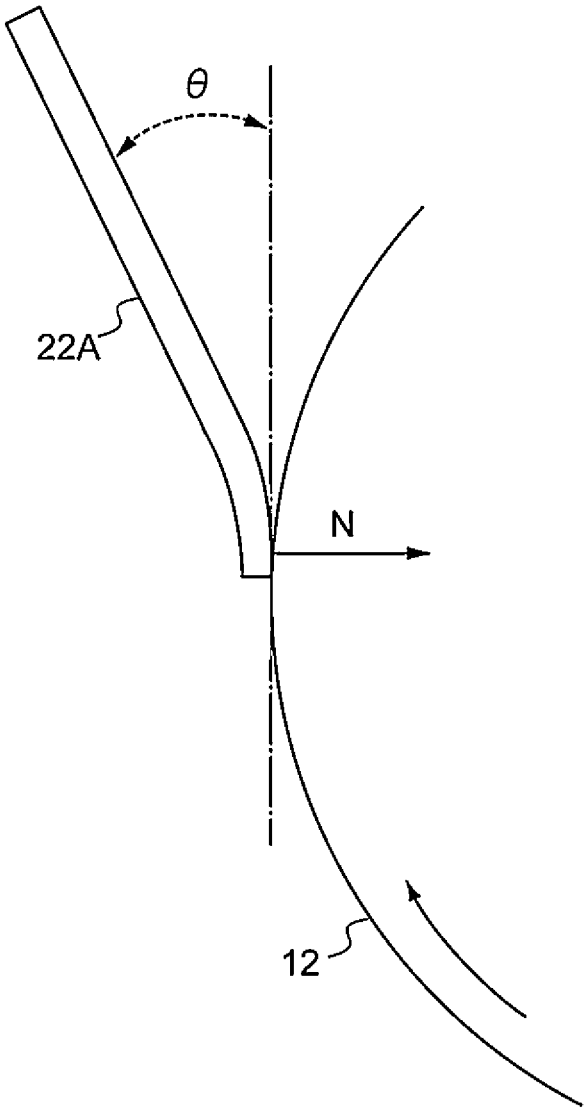
FIG. 3 is an enlarged view taken at a position where a cleaning blade contacts a photoreceptor in the image forming apparatus illustrated in FIG. 1.

FIG. 3 is a schematic diagram illustrating the arrangement of installing the cleaning blade 22A in the cleaning device 22 illustrated in FIG. 1.

As illustrated in FIG. 3, the tip of the cleaning blade 22A is oriented in a direction opposing the rotation direction (arrow direction) of the photoreceptor 12, and contacts the surface of the photoreceptor 12 while maintaining such a state.

The angle θ between the cleaning blade 22A and the photoreceptor 12 may be set to 5° or more and 35° or less, or may be set to 10° or more and 25° or less.

The pressure N from the cleaning blade 22A against the photoreceptor 12 may be set to 0.6 gf/mm$^2$ or more and 6.0 gf/mm$^2$ or less.

Specifically, the angle θ refers to, as illustrated in FIG. 3, the angle formed between a non-deformed part of the cleaning blade 22A and the tangent line (a dotted chain line in FIG. 3) at the contact portion between the tip of the cleaning blade 22A and the photoreceptor 12*a*.

The pressure N is, as illustrated in FIG. 3, the pressure (gf/mm$^2$) that works toward the center of the photoreceptor 12 at the position where the cleaning blade 22A contacts the photoreceptor 12.

In this exemplary embodiment, the cleaning blade 22A is an elastic plate-shaped object. Examples of the material constituting the cleaning blade 22A include elastic materials such as silicone rubber, fluororubber, ethylene-propylene-diene rubber, and polyurethane rubber. Among these, polyurethane rubber, which has excellent mechanical properties such as wear resistance, chipping resistance, and creeping resistance, may be used.

A support member (not illustrated in FIG. 3) is joined to a surface of the cleaning blade 22A opposite of the surface in contact with the photoreceptor 12, and the cleaning blade 22A is supported by this support member. The support member presses the cleaning blade 22A against the photoreceptor 12 at the above-described pressure. The support member may be formed of a metal material, such as aluminum or stainless steel. An adhesive layer formed of an adhesive or the like may be provided between the support member and the cleaning blade 22A so as to bond the support member and the cleaning blade 22A.

The cleaning device may also be equipped with known parts in addition to the cleaning blade 22A and the support member that supports the cleaning blade 22A.

Charge Erasing Device

The charge erasing device 24 is disposed downstream of the cleaning device 22 in the rotation direction of the photoreceptor 12. The change erasing device 24 erases the charges on the surface of the photoreceptor 12 by exposure after the transfer of the toner image. Specifically, for example, the charge erasing device 24 is electrically coupled to the control device 36 in the image forming apparatus 10, and is driven and controlled by the control device 36 so as to expose the entire surface (the entire surface in the image-forming region, for example, to be specific) of the photoreceptor 12 to erase the charges.

Examples of the charge erasing device 24 include devices equipped with light sources such as tungsten lamps that emit white light, and light-emitting diodes (LEDs) that emit red light.

Fixing Device

The fixing device 26 is disposed downstream of the transfer region 32A in the feeding direction of the feed path 34 of the recording medium 30A. The fixing device 26 is equipped with the fixing member 26A and a pressurizing member 26B in contact with the fixing member 26A. The toner image transferred onto the recording medium 30A is fixed in the contact portion between the fixing member 26A and the pressurizing member 26B. Specifically, for example, the fixing device 26 is electrically coupled to the control device 36 in the image forming apparatus 10, and is driven and controlled by the control device 36 so as to fix the toner image on the recording medium 30A by heat and pressure.

Examples of the fixing device 26 include known fixers, such as a thermal roller fixer and an oven fixer.

Specifically, for example, a known fixing device equipped with a fixing roller or a belt serving as the fixing member 26A and a pressurizing roller or belt serving as the pressurizing member 26B is used as the fixing device 26.

Here, the recording medium 30A having a toner image transferred thereon while the recording medium 30A is fed along the feed path 34 and passes through the region (transfer region 32A) where the photoreceptor 12 and the transfer member 20 oppose each other is carried by a feeding member (not illustrated) along the feed path 34 and reaches a position where the fixing device 26 is installed, and then the toner image on the recording medium 30A is fixed.

The recording medium 30A having an image formed thereon as a result of fixing of the toner image is discharged to the outside of the image forming apparatus 10 by multiple feeding members not illustrated in the drawings. The photoreceptor 12 is again charged to the charging potential by the charging device 15 after the charges are erased by the charge erasing device 24.

Operation of Image Forming Apparatus

An example of the operations of the image forming apparatus 10 according to the exemplary embodiment will now be described. The operations of the image forming apparatus 10 are carried out by a control program executed in the control device 36.

An image forming operation of the image forming apparatus 10 will now be described.

First, the surface of the photoreceptor 12 is charged by the charging device 15. The electrostatic image forming device 16 exposes the charged surface of the photoreceptor 12 on the basis of the image information. As a result, an electrostatic image corresponding to the image information is formed on the photoreceptor 12. In the developing device 18, the electrostatic image on the surface of the photoreceptor 12 is developed by the toner-containing developer. As a result, a toner image is formed on the surface of the photoreceptor 12. Since particles of a fatty acid metal salt have been added to the developer (the toner therein) contained in the developing device 18, the particles of the fatty acid metal salt are supplied to the surface of the photoreceptor 12 together with the toner.

In the transfer device 31, the toner image on the photoreceptor 12 is transferred onto the recording medium 30A. The toner image transferred to the recording medium 30A is fixed by the fixing device 26.

Meanwhile, the surface of the photoreceptor 12 after the transfer of the toner image is cleaned by the cleaning blade 22A of the cleaning device 22, and then charges are erased by the charge erasing device 24. In the developing device 18, some of the particles of the fatty acid metal salt supplied to the surface of the photoreceptor 12 remain on the surface of the photoreceptor 12 after the transfer of the toner image by the transfer device 31, and are supplied to the contact position between the cleaning blade 22A and the photoreceptor 12.

Thus, because the fatty acid metal salt is present at the contact position between the cleaning blade 22A and the photoreceptor 12, the cleaning blade 22A achieves high cleaning performance.

Electrostatic Image Developer

Next, the electrostatic image developer contained in the developing unit of the image forming apparatus of the exemplary embodiment (hereinafter, may be referred to as the "electrostatic image developer of the exemplary embodiment") is described.

The electrostatic image developer of the exemplary embodiment contains at least a toner.

The electrostatic image developer of the exemplary embodiment may be a one-component developer that contains only a toner or a two-component developer that contains a toner and a carrier.

The toner contains toner particles and may further contain an external additive.

Toner Particles

The toner particles contain, for example, a binder resin (for example, a polyester resin), a coloring agent, a releasing agent, additives, etc.

The toner particles may be a single-layer-structure toner particles, or core-shell-structure toner particles each constituted by a core (core particle) and a coating layer (shell) coating the core.

The volume-average particle diameter (D50v) of the toner particles may be 2 μm or more and 10 μm or less or may be 4 μm or more and 8 μm or less.

The average particle diameters and particle size distribution indices of the toner particles are measured by using a Coulter Multisizer II (produced by Beckman Coulter Inc.) with ISOTON-II (produced by Beckman Coulter Inc.) as the electrolyte.

In measurement, 0.5 mg or more and 50 mg of the measurement sample is added to 2 ml of a 5% aqueous solution of a surfactant (may be sodium alkyl benzenesulfonate) as the dispersing agent. The resulting mixture is added to 100 ml or more and 150 ml or less of the electrolyte.

The electrolyte in which the sample is suspended is dispersed for 1 minute with an ultrasonic disperser, and the particle size distribution of the particles having a diameter in the range of 2 μm or more and 60 μm or less is measured by using Coulter Multisizer II with apertures having an aperture diameter of 100 μm. The number of the particles sampled is 50,000.

With respect to the particle size ranges (channels) divided on the basis of the measured particle size distribution, cumulative distributions of the volume and the number are plotted from the small diameter side. The particle diameters at 16% cumulation are defined as a volume particle diameter D16v and a number particle diameter D16p, the particle diameter at 50% cumulation are defined to be a volume-average particle diameter D50v and cumulative number-average particle diameter D50p, and the particle diameters at 84% cumulation are defined as a volume particle diameter D84v and a number particle diameter D84p.

The volume particle size distribution index (GSDv) is calculated as $(D84v/D16v)^{1/2}$, and the number particle size distribution index (GSDp) is calculated as $(D84p/D16p)^{1/2}$ by using these values.

The average circularity of the toner particles may be 0.94 or more and 1.00 or less, or may be 0.95 or more and 0.98 or less.

The average circularity of the toner particles is determined by (circle-equivalent perimeter)/(perimeter)[(perimeter of the circle having the same projection area as the particle image)/(perimeter of particle projection image)]. Specifically, it is the value measured by the following method.

First, toner particles to be measured are sampled by suction so as to form a flat flow, and particle images are captured as a still image by performing instantaneous strobe light emission. The particle image is analyzed by a flow particle image analyzer (FPIA-3000 produced by Sysmex Corporation) to determine the average circularity. The number of particles sampled in determining the average circularity is 3500.

When the toner contains an external additive, the toner (developer) to be measured is dispersed in a surfactant-containing water, and then ultrasonically processed to obtain the toner particles from which the external additive has been removed.

External Additive

An example of the external additive is inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as the external additive may be hydrophobized. Hydrophobizing may involve, for example, immersing inorganic particles in a hydrophobizing agent. The hydrophobizing agent may be any, and examples thereof include silane coupling agents, silicone oils, titanate coupling agents, and aluminum coupling agents. These may be used alone or in combination.

The amount of the hydrophobizing agent is typically 1 part by mass or more and 10 parts by mass or less relative to 100 parts by mass of the inorganic particles.

Examples of the external additive include resin particles (resin particles of polystyrene, polymethylmethacrylate (PMMA), melamine resin, etc.), and cleaning activating agents (for example, particles of fluorine-based high-molecular-weight materials).

The amount of the external additive externally added may be, for example, 0.01 mass % or more and 5 mass % or less or may be 0.01 mass % or more and 2.0 mass % or less relative to the toner particles.

Fatty Acid Metal Salt

In supplying the fatty acid metal salt from the developer (the toner therein) contained in the developing device 18 to the photoreceptor 12, in other words, when the developing device 18 also serve as the fatty acid metal salt supply member, the toner contains particles of fatty acid metal salt as an external additive.

The fatty acid may be a saturated or unsaturated fatty acid. Examples of the fatty acid include fatty acids having 10 or more and 25 or less (or 12 or more and 22 or less) carbon atoms. The number of carbon atoms in the fatty acid includes the number of carbon atoms in the carboxy groups. The metal may be a divalent metal. Examples of the metal include magnesium, calcium, aluminum, barium, and zinc. Among these, zinc may be used as the metal.

Examples of the particles of the fatty acid metal salt include metal salts of stearic acid, metal salts of palmitic acid, metal salts of lauric acid, metal salts of oleic acid, metal salts of linoleic acid, and metal salts of ricinoleic acid.

Among these, metal salts of stearic acid or metal salts of lauric acid may be used as the particles of the fatty acid metal salt. In particular, zinc stearate or zinc laurate particles may be used as the particles, and in particular, zinc stearate particles may be used as the particles.

The volume-average particle diameter of the particles of the fatty acid metal salt may be 0.8 times the volume-average particle diameter of the toner particles or more and 1.2 times the volume-average particle diameter of the toner particles or less. The volume-average particle diameter of the particles of the fatty acid metal salt may be 0.3 μm or more and 8 μm or less or may be 0.5 μm or more and 5.0 μm or less.

The volume-average particle diameter of the particles of the fatty acid metal salt is a value measured by the following method.

First, the toner to be measured is observed with a scanning electron microscope (SEM). Then image is analyzed to determine the equivalent circle diameters of one hundred particles of the fatty acid metal salt to be measured. In the volume-base distribution of the equivalent circle diameter, 50% number cumulative equivalent circle diameter (equivalent circle diameter of the 50th particles) from the small diameter side is assumed to be the volume-average particle diameter.

The image analysis for determining the equivalent circle diameters of one hundred particles of the fatty acid metal salt to be measured involves taking a two-dimensional image at a magnification factor of 10,000 by using an analyzer (ERA-8900 produced by ELIONIX INC.), determining the projection areas by using image analysis software WinROOF (produced by MITANI Corporation) under the condition of 0.010000 μm/pixel, and determining the equivalent circle diameters by formula: equivalent circle diameter=$2\sqrt{(\text{projection area}/\pi)}$.

The amount (amount externally added) of the particles of the fatty acid metal salt relative to 100 parts by mass of the toner particles may be 0.02 parts by mass or more and 5 parts by mass or less, may be 0.05 parts by mass or more and 3.0 parts by mass or less, or may be 0.08 parts by mass or more and 1.0 parts by mass or less.

Other Modes of Fatty Acid Metal Salt Supply Device

Figure 2:
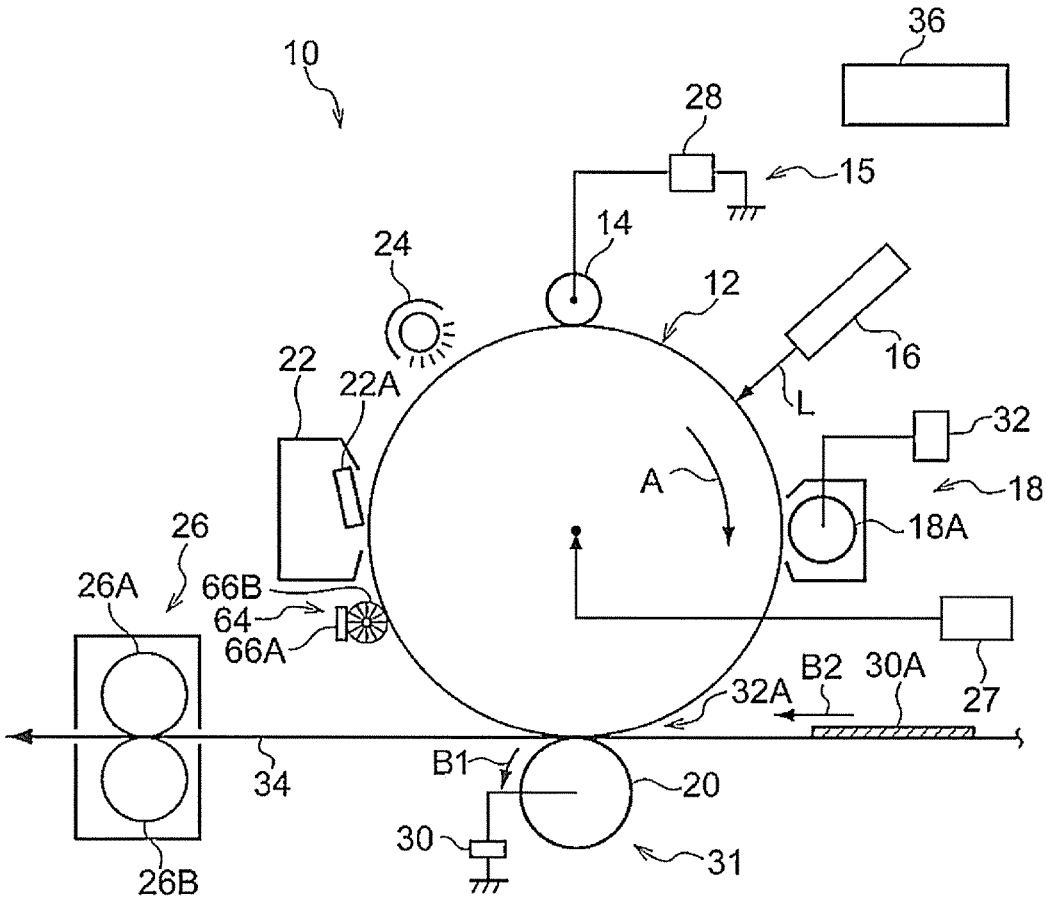
FIG. 2 is a schematic diagram illustrating another example of an image forming apparatus according to the exemplary embodiment.

In FIG. 1, a method for supplying a fatty acid metal salt to the surface of the photoreceptor 12 is illustrated, in which the particles of the fatty acid metal salt are externally added to the developer (the toner therein) contained in the developing device 18 so that the developing device 18 also serves as the supply unit. However, the mode of the supply unit of this exemplary embodiment is not limited to this. For example, as illustrated in FIG. 2, an external supply device 64 that supplies the fatty acid metal salt to the surface of the photoreceptor 12 may be separately installed. In this mode, the developer (toner) containing particles of the fatty acid metal salt need not be used.

The external supply device 64 is, for example, a known device such as a device equipped with a rotating brush 66B that scrapes a fatty acid metal salt 66A and supplies the scraped fatty acid metal salt 66A to the surface of the photoreceptor 12.

Thus, because the fatty acid metal salt is supplied to the contact position between the cleaning blade 22A and the photoreceptor 12, and the cleaning blade 22A that contacts the surface of the photoreceptor 12 achieves high cleaning performance.

A solid fatty acid metal salt may be used as the fatty acid metal salt 66A.

Examples of the fatty acid metal salt are those described as examples of the particles of the fatty acid metal salt to be externally added to the toner.

The structure of the image forming apparatus described in the exemplary embodiment is merely one example, and, naturally, the structure may be modified without departing from the gist of the exemplary embodiment.

EXAMPLES

The present invention will now be more specifically described through Examples and Comparative Examples which do not limit the present invention.

Preparation of Electrophotographic Photoreceptor

Preparation of Silica Particles

To 100 parts by mass of untreated (hydrophilic) silica particles "trade name: OX50 (produced by Nippon Aerosil Co., Ltd.), volume-average particle diameter: 40 nm", 30 parts by mass of a trimethylsilane compound (1,1,1,3,3,3-hexamethyldisilazane (produced by Tokyo Chemical Industry Co., Ltd.)) is added as a hydrophobizing agent, and the resulting mixture is reacted for 24 hours, followed by filtration, to obtain hydrophobized silica particles. These silica particles are assumed to be silica particles (1). The condensation ratio of these silica particles (1) is 93%.

Preparation of Electrophotographic Photoreceptor 1

Preparation of Undercoat Layer

One hundred parts by mass of zinc oxide (average particle diameter: 70 nm, produced by Tayca Corporation, specific surface area: 15 $m^2/g$) and 500 parts by mass of tetrahydrofuran are mixed and stirred, and 1.3 parts by mass of a silane coupling agent (KBM503 produced by Shin-Etsu Chemical Co., Ltd.) is added to the resulting mixture, followed by stirring for 2 hours. Then, tetrahydrofuran is distilled away by vacuum distillation, baking is performed at 120° C. for 3 hours, and, as a result, zinc oxide surface-treated with a silane coupling agent is obtained.

One hundred and ten parts by mass of the surface-treated zinc oxide (zinc oxide surface-treated with a silane coupling agent) and 500 parts by mass of tetrahydrofuran are mixed and stirred, a solution prepared by dissolving 0.6 parts by mass of alizarin in 50 parts by mass of tetrahydrofuran is added to the resulting mixture, and the resulting mixture is stirred at 50° C. for 5 hours. Subsequently, alizarin-doped zinc oxide is separated by vacuum filtration and vacuum-dried at 60° C. As a result, alizarin-doped zinc oxide is obtained.

Sixty parts by mass of the alizarin-doped zinc oxide, 13.5 parts by mass of a curing agent (blocked isocyanate, Sumidur 3175 produced by Sumitomo Bayer Urethane Co., Ltd.), 15 parts by mass of a butyral resin (S-LEC BM-1 produced by Sekisui Chemical Co., Ltd.), and 85 parts by mass of methyl ethyl ketone are mixed to obtain a mixed solution. To 38 parts by mass of this mixed solution, 25 parts by mass of methyl ethyl ketone is added, and the resulting mixture is dispersed in a sand mill with 1 mm ϕ glass beads for 2 hours so as to obtain a dispersion.

To the resulting dispersion, 0.005 parts by mass of dioctyltin dilaurate serving as a catalyst and 40 parts by mass of silicone resin particles (Tospearl 145 produced by Momentive Performance Materials Inc.) are added to obtain an undercoat-layer-forming solution. The solution is applied to an aluminum substrate having a diameter of 60 mm, a length of 357 mm, and a thickness of 1 mm by a dip coating method, and dried and cured at 170° C. for 40 minutes, so as to obtain an undercoat layer having a thickness of 19 μm.

Preparation of Charge Generating Layer

A mixture containing 15 parts by mass of hydroxygallium phthalocyanine serving as a charge generating material and having diffraction peaks at least at Bragg's angles (2θ±0.2°) of 7.3°, 16.0°, 24.9°, and 28.0° in an X-ray diffraction spectrum obtained by using CuKα X-ray, 10 parts by mass of a vinyl chloride-vinyl acetate copolymer (VMCH produced by NUC Corporation) serving as a binder resin, and 200 parts by mass of n-butyl acetate is dispersed in a sand mill with glass beads having a diameter ϕ of 1 mm for 4 hours. To the resulting dispersion, 175 parts by mass of n-butyl acetate and 180 parts by mass of methyl ethyl ketone are added and stirred so as to obtain a coating solution for forming a charge generating layer. This coating solution for forming a charge generating layer is applied to the undercoat layer by dip coating, and dried at room temperature (25° C.) to form a charge generating layer having a thickness of 0.2 μm.

Preparation of Charge Transporting Layer

To 50 parts by mass of silica particles (1), 250 parts by mass of tetrahydrofuran is added. To the resulting mixture kept at a liquid temperature of 20° C., 25 parts by mass of 4-(2,2-diphenylethyl)-4',4"-dimethyl-triphenylamine serving as a charge transporting material, and 25 parts by mass of a bisphenol Z-type polycarbonate resin (viscosity-average molecular weight: 30000) serving as a binder resin are added, and the resulting mixture is stirred and mixed for 12 hours to obtain a charge-transporting-layer-forming solution.

This charge-transporting-layer-forming solution is applied to the charge generating layer, and dried at 135° C. for 40 minutes to form a charge transporting layer having a thickness of 30 μm so as to form an organic photoreceptor (1).

Through the above-described steps, an organic photoreceptor (1) in which an undercoat layer, a charge generating layer, and a charge transporting layer are stacked on an aluminum substrate in that order is obtained.

Formation of Inorganic Surface Layer

Next, an inorganic surface layer composed of hydrogen-containing gallium oxide is formed on a surface of the organic photoreceptor (1). The inorganic surface layer is formed by using a film forming apparatus having the structure illustrated in FIGS. 4A and 4B.

First, the organic photoreceptor (1) is placed on the substrate supporting member 213 in the deposition chamber 210 of the film forming apparatus, and the interior of the deposition chamber 210 is vacuum-evacuated through the exhaust port 211 until the pressure reaches 0.1 Pa.

Next, He-diluted 40% oxygen gas (flow rate: 1.6 sccm) and hydrogen gas (flow rate: 50 sccm) are introduced from the gas inlet duct 220 into the high-frequency discharge tube portion 221 in which the flat plate electrode 219 having a diameter of 85 mm is provided; and, by using the high-frequency power supply unit 218 and a matching circuit (not illustrated in FIGS. 4A and 4B), a 13.56 MHz radio wave is set to an output of 150 W and discharging is performed from the flat plate electrode 219 by matching with a tuner. The reflected wave during this process is 0 W.

Next, trimethylgallium gas (flow rate: 1.9 sccm) is introduced from the gas inlet duct 215 through the shower nozzle 216 into the plasma diffusing section 217 inside the deposition chamber 210. During this process, the reaction pressure inside the deposition chamber 210 measured by a Baratron vacuum gauge is 5.3 Pa.

Under this condition, the organic photoreceptor (1) is rotated at a speed of 500 rpm while conducting film formation for 68 minutes so as to form an inorganic surface layer having a thickness of 1.5 μm on the surface of the charge transporting layer of the organic photoreceptor (1).

The surface roughness Ra of the outer circumferential surface of the inorganic surface layer is 1.9 nm.

The element compositional ratio of oxygen to gallium (oxygen/gallium) in the inorganic surface layer is 1.25.

Through the above-described steps, an electrophotographic photoreceptor 1 in which an undercoat layer, a charge generating layer, a charge transporting layer, and an inorganic surface layer are stacked on a conductive substrate in that order is obtained.

Preparation of Electrophotographic Photoreceptor (For Comparison)

An electrophotographic photoreceptor (for comparison) is obtained as with the electrophotographic photoreceptor 1 except that no inorganic surface layer is formed.

Reference Example and Examples 1 and 2

Preparation of Image Forming Apparatus (1)

As the image forming apparatus (1), a modified model of an image forming apparatus, "DocuCentreIV 5570" (produced by Fuji Xerox Co., Ltd.) (as illustrated in FIG. 2, this is an image forming apparatus in which the cleaning device 22 is equipped with the cleaning blade 22A composed of polyurethane rubber and in contact with the surface of the photoreceptor 12, the image forming apparatus including the external supply device 64 that supplies the fatty acid metal salt 66A to the surface of the photoreceptor 12 by using a rotating brush 66B, and a charging roller in contact with the photoreceptor to charge the surface and that serves as the charging device 15) is prepared.

The angle (contact angle) θ between the cleaning blade 22A and the photoreceptor 12 is set to 11°, and the pressure N of pressing the cleaning blade 22A against the photoreceptor 12 is set to 2.5 gf/mm$^2$.

As the fatty acid metal salt 66A, a solid zinc stearate plate is prepared.

The electrophotographic photoreceptor 1 described above is assembled into the photoreceptor of this image forming apparatus.

The metal coverage (zinc coverage) of the surface of the electrophotographic photoreceptor is adjusted to a value described in Table by adjusting the amount supplied from the external supply device 64.

Comparative Examples 1 to 3

Preparation of Image Forming Apparatus (For Comparison)

An image forming apparatus (for comparison) is prepared as with the image forming apparatus (1) except that the photoreceptor to be assembled is changed to the electrophotographic photoreceptor (for comparison) described above.

The metal coverage (zinc coverage) of the surface of the electrophotographic photoreceptor is adjusted to a value described in Table by adjusting the amount supplied from the external supply device 64.

Evaluation

Photoreceptor Wear Rate

Each of the image forming apparatuses of the examples is operated to create 20,000 sheets of an image having a halftone density of 50%, and the amount of wear of the surface of the electrophotographic photoreceptor before and after the image formation is determined to calculate the photoreceptor wear rate [nm/k cycle](k cycle=1000 rotations of the photoreceptor).

Deletion Evaluation

The image forming apparatuses of the respective examples are evaluated by the following test for deletion (phenomenon in which the image is partly left blank, specifically, image deletion or white voids) in a high-temperature, high-humidity environment (28° C., 85% RH).

In a high-temperature, high-humidity environment, an image having a halftone density of 50% is printed on 1,000 sheets by using each of the image forming apparatuses described above. Then the apparatuses are left to stand still overnight, and then an image having a halftone density of 40% is printed on 100 sheets to identify the extent of deletion.

The evaluation standards are as follows.

A: No deletion occurs on the first sheet of printed image or onward.

B: Deletion occurs on the first sheet of printed image, but the deletion-free state is recovered by the tenth sheet.

C: Deletion occurs on the first sheet of printed image, but the deletion-free state is recovered by the hundredth sheet.

D: Deletion occurs even on the hundredth sheet.

Charging Roller Contamination Evaluation

Occurrence of contamination in the charging roller is evaluated for each of the image forming apparatuses of the respective examples by the following test.

In a high-temperature, high-humidity environment, an image having a halftone density of 50% is printed on 5,000 sheets by using each of the image forming apparatuses, and further 5,000 sheets of printout are made in a low-temperature, low-humidity (10° C., 15% RH). Then, the contamination state is checked visually by comparing the charging roller with a brand new charging roller.

The evaluation standards are as follows.

A: About the same level as the brand-new product.

B: Cloudy compared to the brand-new product and A.

C: Cloudy and having white streaks compared to the brand-new product and A.

D: White compared to the brand-new product.

TABLE

| | Electrophotographic photoreceptor | | Evaluation | | |
|---|---|---|---|---|---|
| | Inorganic surface layer | Zinc coverage [%] | Wear rate [nm/k cycle] | Deletion | Charging roller contamination |
| Reference Example | Present (gallium oxide) | 30 | 1.3 | D | B |
| Example 1 | Present (gallium oxide) | 40 | 0.4 | B | A |
| Example 2 | Present (gallium oxide) | 60 | 0.1 or lower | A | A |
| Comparative Example 1 | Absent | 30 | 10 | A | A |
| Comparative Example 2 | Absent | 40 | 9 | B | B |
| Comparative Example 3 | Absent | 60 | 7 | C | D |

The results described above show that regarding an image forming apparatus in which the surface of the electrophotographic photoreceptor is cleaned by contacting a cleaning blade, compared to the image forming apparatuses of Comparative Examples in which no inorganic surface layer is provided and the photosensitive layer constitutes the outer circumferential surface, the image forming apparatuses of Examples having electrophotographic photoreceptors equipped with inorganic surface layers containing a group 13 element and oxygen can achieve high cleaning performance by the cleaning blade and suppression of contamination in the apparatus by the fatty acid metal salt even when a portion of the surface of the photoreceptor downstream of the supply unit and upstream of the cleaning unit in a rotating direction of the electrophotographic photoreceptor is covered with a metal derived from the fatty acid metal salt at a coverage of 40% or more when the fatty acid metal salt is supplied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that includes a conductive substrate, a photosensitive layer, and an inorganic surface layer arranged in that order, the inorganic surface layer containing a group 13 element and oxygen;

a charging unit that charges a surface of the electrophotographic photoreceptor;

an electrostatic image-forming unit that forms an electrostatic image on the charged surface of the electrophotographic photoreceptor;

a developing unit that supplies an electrostatic image developer to develop the electrostatic image on the surface of the electrophotographic photoreceptor so as to form a toner image;

a transfer unit that transfers the toner image on the surface of the electrophotographic photoreceptor onto a surface of a recording medium;

a cleaning unit that performs cleaning by causing a cleaning blade to contact the surface of the electrophotographic photoreceptor; and a supply unit that supplies a fatty acid metal salt to a position where the cleaning blade in the cleaning unit contacts the electrophotographic photoreceptor, wherein, when the fatty acid metal salt is supplied, a portion of the surface of the electrophotographic photoreceptor downstream of the supply unit and upstream of the cleaning unit in a rotating direction of the electrophotographic photoreceptor is covered with a metal derived from the fatty acid metal salt at a coverage of about 40% or more.

2. The image forming apparatus according to claim 1, wherein the coverage is about 45% or more.

3. The image forming apparatus according to claim 2, wherein the coverage is about 50% or more.

4. The image forming apparatus according to claim 1, wherein the fatty acid metal salt is zinc stearate.

5. The image forming apparatus according to claim 1, wherein the supply unit is a unit provided separately from the developing unit.

6. The image forming apparatus according to claim 1, wherein the inorganic surface layer has an element compositional ratio (oxygen/group 13 element) of oxygen to the group 13 element of about 1.0 or more and less than about 1.5.

7. The image forming apparatus according to claim 1, wherein the group 13 element is gallium.

8. The image forming apparatus according to claim 1, wherein the inorganic surface layer further contains hydrogen.

9. The image forming apparatus according to claim 1, wherein a sum of element compositional percentages of the group 13 element, oxygen, and hydrogen relative to all elements constituting the inorganic surface layer is about 90 atom % or more.

10. The image forming apparatus according to claim 1, wherein the charging unit is equipped with a charging roller that contacts the electrophotographic photoreceptor and charges the surface of the electrophotographic photoreceptor.

11. The image forming apparatus according to claim 1, wherein the photosensitive layer includes a layer constituting an outer circumferential surface, and at least the layer constituting the outer circumferential surface contains about 55 mass % or more and about 90 mass % or less of silica particles relative to a solid content of that layer.

12. A unit to be applied to an image forming apparatus equipped with a cleaning mechanism that performs cleaning by causing a cleaning blade to contact a surface of an electrophotographic photoreceptor, the unit comprising:

an electrophotographic photoreceptor that includes a conductive substrate, a photosensitive layer, and an inorganic surface layer arranged in that order, the inorganic surface layer containing a group 13 element and oxygen; and a supply unit that supplies a fatty acid metal salt to a position where the cleaning blade contacts the electrophotographic photoreceptor, wherein, when the fatty acid metal salt is supplied, a portion of the surface of the electrophotographic photoreceptor downstream of the supply unit and upstream of a position where the cleaning blade contacts the electrophotographic photoreceptor in a rotating direction of the electrophotographic photoreceptor is covered with a metal derived from the fatty acid metal salt at a coverage of about 40% or more.

* * * * *